US007651190B2

(12) United States Patent
Umeda

(10) Patent No.: US 7,651,190 B2
(45) Date of Patent: Jan. 26, 2010

(54) INKJET RECORDING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 273 days.

(21) Appl. No.: 11/412,794

(22) Filed: Apr. 28, 2006

(65) Prior Publication Data

US 2006/0244775 A1 Nov. 2, 2006

(30) Foreign Application Priority Data

Apr. 28, 2005 (JP) ..... 2005-133658

(51) Int. Cl.
*B41J 29/393* (2006.01)

(52) U.S. Cl. ..... 347/19; 347/5; 347/55

(58) Field of Classification Search ..... 347/55, 347/5, 9, 12, 19
See application file for complete search history.

(56) References Cited

U.S. PATENT DOCUMENTS 4,590,482 A * 5/1986 Hay et al. ..... 347/19
5,905,510 A * 5/1999 Hagiwara et al. ..... 347/7
6,158,844 A * 12/2000 Murakami et al. ..... 347/55
6,994,417 B2 2/2006 Murayama et al.
2002/0021315 A1 2/2002 Sato et al.
2004/0017441 A1 1/2004 Shin et al.
2004/0207676 A1 10/2004 Yamada et al.

FOREIGN PATENT DOCUMENTS

EP 1484178 A1 12/2004
JP H03 202354 9/1991
JP 2003 191463 7/2003

OTHER PUBLICATIONS

European Patent Office, European Search Report for EP Appl'n No. 06252234.7-2304 (counterpart to above-captioned patent appl'n) mailed Aug. 1, 2006.
European Patent Office, Communication Pursuant to Art. 96(2) EPC in EP Appl'n No. 06252234.7-1251 (counterpart to above-captioned U.S. patent appl'n) dated Sep. 19, 2007.

* cited by examiner

*Primary Examiner*—Lam S Nguyen
(74) *Attorney, Agent, or Firm*—Baker Botts, LLP

(57) ABSTRACT

A recording head includes a main body and electrodes. The main body has a nozzle plate. The electrodes are arranged on the front surface of the nozzle plate. A current sensor is connected to the electrodes through connection terminals, and measures a current value flowing in the respective electrodes. The electrodes correspond respectively to the colors of inks to be discharged. Each of the electrodes is separated from the edge of the nozzle hole by 1 μm to 5 μm. The nozzle plate has a water repellent layer on the front surface. The electrodes connect a plurality of nozzle holes in series.

11 Claims, 15 Drawing Sheets

INKJET RECORDING APPARATUS

CROSS-REFERENCE TO RELATED APPLICATION

This non-provisional application claims priority under 35 U.S.C. §119(a) on Patent Application No. 2005-133658 filed in Japan on Apr. 28, 2005, the entire contents of which are hereby incorporated by reference.

BACKGROUND

The present invention relates to an inkjet recording apparatus comprising an inkjet recording head for discharging ink droplets, and more particularly relates to the structure of the inkjet recording head.

There have conventionally been provided inkjet recording apparatuses for recording an image on a recording medium by discharging ink droplets onto the recording medium. The ink droplets are discharged from an inkjet recording head incorporated into an inkjet recording apparatus. The inkjet recording head comprises a plurality of nozzles for discharging ink droplets, and an actuator such as a piezoelectric element, an electrostrictive element, or a heating element. With local boiling of an ink caused by bending or heat of the actuator, ink droplets are discharged from the nozzles. This inkjet recording head is mounted on a scanning carriage that moves reciprocally in directions orthogonal to the transport direction of the recording medium. The recording medium is transported by a predetermined width of line feed in the transport direction, and the scanning carriage is moved every time line feed is performed. With the movement of the scanning carriage, the inkjet recording head discharges ink droplets from the nozzles in a predetermined timing. Consequently, an image is recorded on the recording medium.

In the inkjet recording apparatus, it is important to certainly discharge ink droplets from all the nozzles. The reason for this is that, if any one of the nozzles is clogged with a foreign object or has an air bubble, a discharge defect of ink droplets occurs and the image quality deteriorates. In order to prevent clogging of nozzles and entry of an air bubble into the nozzles, purging or flushing of the inkjet recording head is generally performed. However, these operations are not intended to directly detect the clogging of nozzles or entry of an air bubble. Therefore, conventionally, there were proposed inkjet recording apparatuses capable of actively detecting the clogging of nozzles (see Japanese Patent Applications Laid-Open No. 2003-191463 and No. H03-202354 (1991)).

SUMMARY

In a conventional inkjet recording apparatus, in order to detect clogging of nozzles, the inkjet recording head must be moved to a predetermined detection position (typically, a position where purging or flushing is performed) different from a usual printing area. In other words, clogging of nozzles can never be detected during or immediately before printing, and thus there is a possibility that a printing operation may be performed in a state in which a nozzle is clogged. As a result, in order to certainly detect clogging of nozzles, there is no method other than a method that requires the user to confirm an image after being printed.

It is therefore an object to provide an inkjet recording apparatus capable of certainly detecting an ink discharge defect due to clogging of a nozzle or entry of an air bubble even when a printing operation is being performed.

In order to achieve the above object, an inkjet recording apparatus according to the first aspect comprises: a recording head main body having a nozzle plate in which a plurality of nozzle holes are arranged; electrodes arranged adjacently with the nozzle hole therebetween; current detecting means for applying a predetermined voltage between the electrodes and detecting a current flowing between the electrodes; and determining means for determining, based on a detection result from the current detecting means, that a conductive state occurs between the electrodes.

In order to satisfactorily discharge an ink droplet from the inkjet recording head, a meniscus needs to be formed normally in the nozzle hole and follow the deformation (oscillation) of a piezoelectric element or the like provided in the inkjet recording head. Here, the "normal meniscus" means a state in which an ink liquid surface is formed in a concave shape curved from the outside edge of the nozzle hole to the inner side when seen in a cross section, and the ink liquid surface is positioned on the outside edge of the nozzle hole. When the ink is discharged as an ink droplet from the nozzle hole in the state in which the normal meniscus is formed, the ink behaves as follows. Specifically, with the deformation of the piezoelectric element or the like, the normal meniscus further retreats deep into the nozzle hole once, and then the ink is pushed out as if it is shot from the nozzle hole with the recovery of deformation of the piezoelectric element or the like.

If an air bubble, etc. have already entered the nozzle hole before the discharge of an ink droplet, the meniscus of the ink retreats deep into the nozzle hole, and therefore the ink can not be ejected from the nozzle hole. On the other hand, if an air bubble exists in the flow channel on the upstream side of the nozzle hole before the discharge of an ink droplet, the air bubble functions as a kind of cushioning material when the piezoelectric element or the like deforms. In other words, even when the meniscus is formed normally before the discharge of the ink droplet, a change in the pressure of the ink due to the deformation of the piezoelectric element or the like deforms the air bubble, and the ink in the nozzle hole can not be ejected from the nozzle hole. However, when the normal meniscus follows the deformation (oscillation) of the piezoelectric element or the like, the ink retreats into the nozzle hole once according to the deformation of the piezoelectric element or the like, and then forms a column shape and sticks out of the nozzle hole, and a part of the columnar ink separates and is ejected as an ink droplet.

On the other hand, the columnar ink after the separation of the ink droplet retreats again toward the nozzle hole. However, at this time, the tip of the columnar ink spreads in the radial direction due to a reaction of the separation of the ink droplet, and adheres to the periphery of the opening edge of the nozzle hole. However, the inside of the nozzle hole always has a negative pressure (not higher than atmospheric pressure), the columnar ink retreats as if it is pulled into the nozzle hole. Accordingly, the ink adhering to the periphery of the opening edge of the nozzle hole also retreats into the nozzle hole as if it is pulled by the columnar ink. The ink that has retreated into the nozzle hole forms the normal meniscus again.

In the first aspect, since the electrodes are arranged adjacently with the nozzle hole therebetween, if a part of the ink adheres to the periphery of the opening edge of the nozzle hole after the ejection of an ink droplet from the nozzle hole as described above, the ink functions as an electrically conductive material. Thus, with the adhesion of the ink, a current flows between the electrodes. At this time, the determining means determines that a conductive state occurs between the electrodes. In other words, the fact that the ink droplet was certainly discharged from the nozzle hole is detected.

According to the first aspect, the fact that an ink droplet was certainly discharged during printing is detected, or the fact that an ink droplet is in a state capable of being certainly discharged is detected before the discharge of the ink droplet. Therefore, if a discharge defect of the ink droplet is caused by some reason, or if there is a high possibility of discharge defect of the ink droplet, this is certainly detected even during printing (typically during a flushing operation at the time of line feed, or a flushing operation performed immediately before printing). Further, in the inkjet recording apparatus, it is usually possible to prevent clogging of the inkjet recording head and remaining of the air bubble by periodically performing flushing or purging even during printing. Therefore, when discharge defect of the ink droplet, etc. is detected, it is possible to correct the discharge defect when performing periodical flushing or the like.

The above and further objects and features will more fully be apparent from the following detailed description with accompanying drawings.

DETAILED DESCRIPTION OF THE EXEMPLARY EMBODIMENTS

Figure 1:
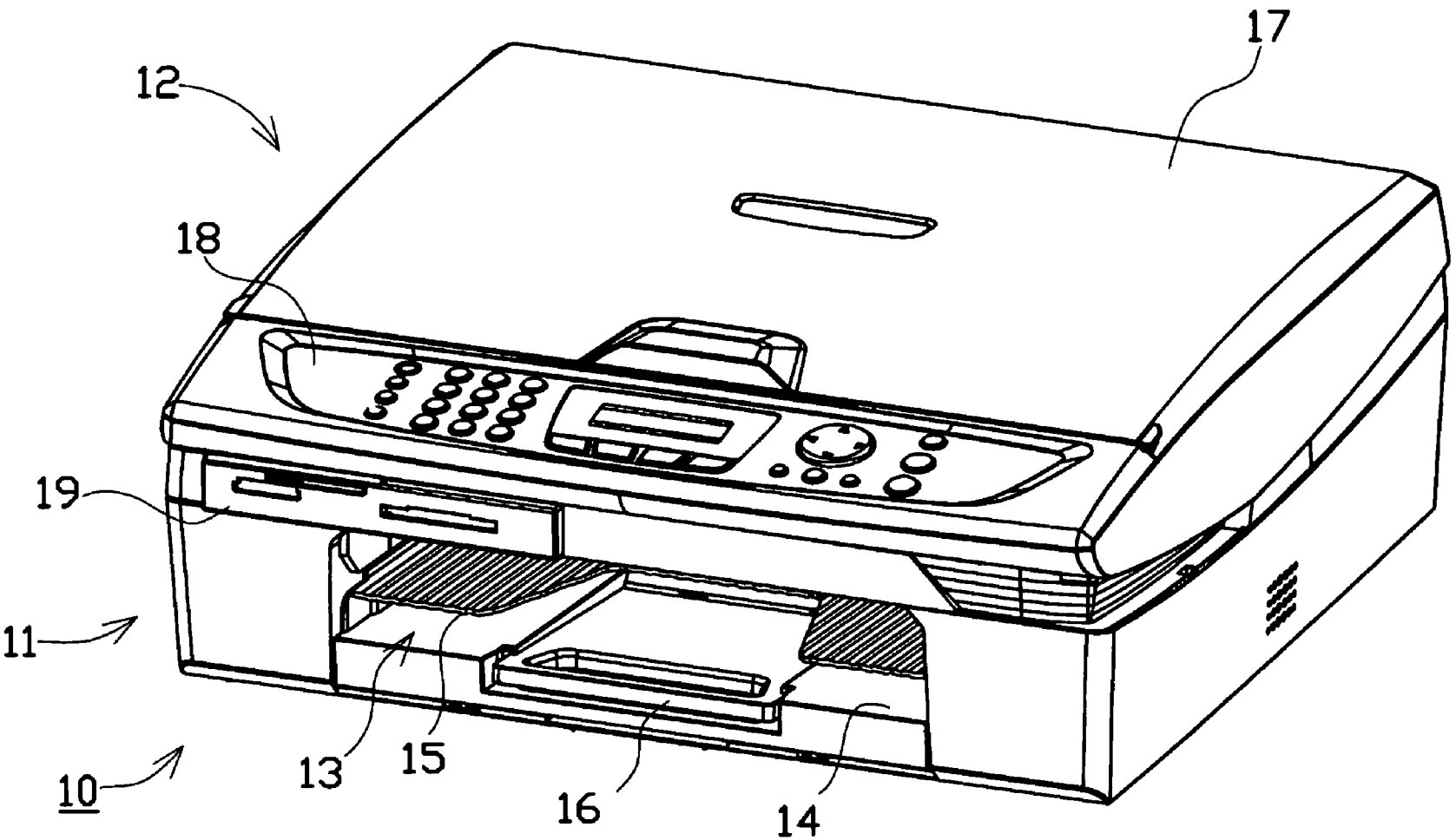
FIG. 1 is a perspective view of the appearance of a complex machine according to the first embodiment.

The following description will explain in detail preferred embodiments by suitably referring to the drawings.

First Embodiment

FIG. 1 is a perspective view of the appearance of a complex machine 10 (inkjet recording apparatus) according to the first embodiment.

The complex machine 10 is a multi-function device (MFD) comprising integrally a printer section 11 in the lower part thereof and a scanner section 12 in the upper part, and has a printer function, a scanner function and a copy function. The printer section 11 in the complex machine 10 corresponds to an inkjet recording apparatus. It may be possible to omit the functions other than the printer function. Accordingly, this embodiment is applicable to a single-function printer having no scanner function and copy function, and is also applicable to a printer with a communication section having a facsimile function, etc.

When this embodiment is implemented as an inkjet recording apparatus that is a complex machine, it may be constructed as a small apparatus such as the complex machine 10 according to this embodiment, or may be constructed as a large apparatus including a plurality of paper feed cassettes and an auto-document feeder (ADF). This embodiment is applicable not only to an inkjet recording apparatus, but also generally to an image recording apparatus comprising a recording head for performing an image recording operation on a recording medium (typically, recording paper). Moreover, the complex machine 10 may be mainly connected to a computer, not shown, and constructed to record an image or document on recording paper, based on image data or document data sent from the computer. Further, the complex machine 10 may be connected to a digital camera and constructed to record image data outputted from the digital camera on recording paper, or record image data stored in various kinds of storage media on recording paper by inserting such a storage medium.

As shown in FIG. 1, the complex machine 10 has generally a wide, thin rectangular parallelepiped external shape. The width and depth of the complex machine 10 are set larger than the height. The printer section 11 is provided in the lower part of the complex machine 10. The printer section 11 has an opening 13 in the front face. A paper feed tray 14 and a paper discharge tray 15 are arranged on two levels in a vertical direction so that they are exposed through the opening 13. The paper feed tray 14 is for storing recording paper, and capable of storing recording paper in various sizes no larger than A4 size, such as B5 size and postcard size. The paper feed tray 14 comprises a slide tray 16. The tray surface becomes larger by pulling out the slide tray 16 if necessary. The recording paper stored in the paper feed tray 14 is fed into the printer section 11 to record a predetermined image, and then discharged to the paper discharge tray 15.

The scanner section 12 is provided in the upper part of the complex machine 10. The scanner section 12 is constructed as a so-called flat bed scanner. The complex machine 10 comprises a document cover 17. The document cover 17 is mounted on the complex machine 10 so that it is freely opened and closed, and constructed as a top plate of the complex machine 10. A platen glass (not shown) and an image reading carriage are provided on the lower side of the document cover 17. The platen glass is for placing a document. The image reading carriage is mounted under the platen glass, and can slide in the width direction of the complex machine 10. The image reading carriage scans a document by sliding in the width direction of the complex machine 10.

An operation panel 18 is provided at the upper part of the front face of the complex machine 10. The operation panel 18 is for operating the printer section 11 and the scanner section 12. The operation panel 18 has various kinds of operation buttons and a liquid crystal display section. The complex machine 10 operates according to an operation instruction from the operation panel 18, or an instruction sent from the computer through a printer driver. In addition, a slot section 19 is provided in the upper left part of the front face of the complex machine 10. Various kinds of small memory cards as storage media are inserted into the slot section 19. The image data stored in a small memory card is displayed on the liquid crystal display section. When the operation panel 18 is operated, an arbitrary image stored in the small memory card is recorded on the recording paper by the printer section 11.

Figure 2:
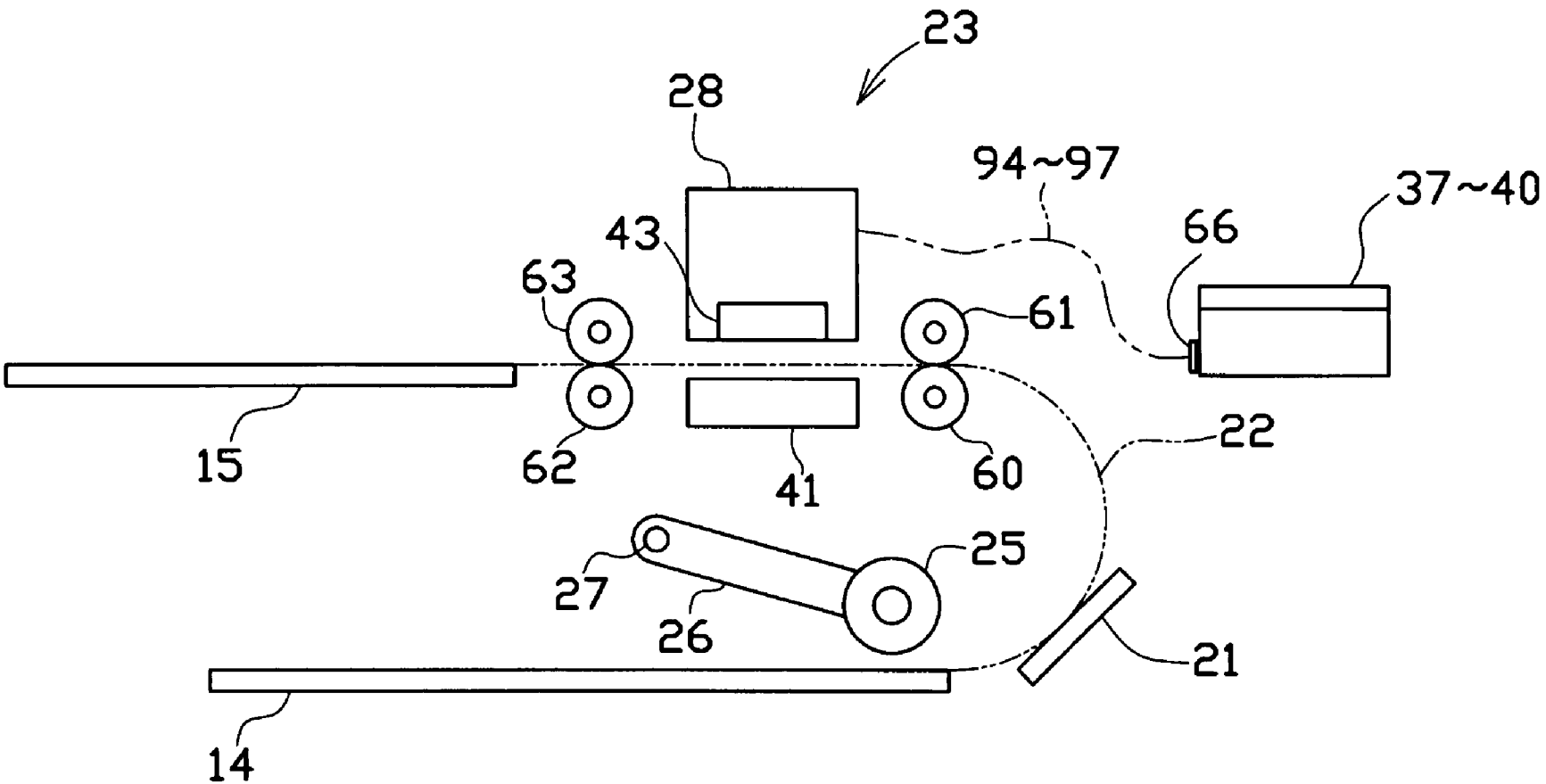
FIG. 2 is a schematic view showing the structure of a printer section of the complex machine according to the first embodiment.

FIG. 2 is a schematic view showing the structure of the printer section 11 of the complex machine 10. In FIG. 2, a direction perpendicular to the plane of the paper is the width direction of the complex machine 10 and is also a later-described main scanning direction of a recording head 43.

The paper feed tray 14 is provided at the bottom of the complex machine 10. Disposed on the back side (right side in FIG. 2) of the paper feed tray 14 is a separation tilt plate 21 for separating a piece of recording paper stacked on the paper feed tray 14 and guiding it upward. A transport path 22 is formed to run upward from the separation tilt plate 21. The transport path 22 extends upward and is then curved to the left, so that it extends from the back side to the front side of the complex machine 10 (from the right side to the left side in FIG. 2). Further, the transport path 22 passes through an image recording section 23 and reaches the paper discharge tray 15. Hence, the recording paper stored in the paper feed tray 14 is guided from the lower side to the upper side as if it makes a U turn along the transport path 22, and reaches the image recording section 23. After the image recording section 23 records an image on the recording paper, the recording paper is discharged onto the paper discharge tray 15. The direction along the transport path 22 is the transport direction of the recording paper. The transport direction and the above-mentioned main scanning direction cross each other at a right angle.

A paper feed roller 25 is provided above the paper feed tray 14. The paper feed roller 25 separates recording paper one sheet at a time from the recording paper stacked on the paper feed tray 14 and supplies it to the paper transport path 22. The paper feed roller 25 has a known structure, and, for example, is supported with a shaft located on an end of a paper feed arm 26 that moves up and down to make contact with or separate from the paper feed tray 14. The paper feed roller 25 is connected to a motor through a drive transmission mechanism. The drive transmission mechanism may be constructed by engaging a plurality of gears with each other. When the motor is activated, a drive force thereof is transmitted to the paper feed roller 25, and the paper feed roller 25 rotates.

The paper feed arm 26 is arranged rotatably around a base end shaft 27. Thus, the paper feed arm 26 can swing in the upward and downward directions about the base end shaft 27 as the center of swing. The paper feed arm 26 is lifted up by a paper feed clutch, spring, etc. (not shown) when it is in a standby state, and swings downward when supplying the recording paper. When the paper feed arm 26 swings downward, the paper feed roller 25 supported on the end of the paper feed arm 26 is pressed against the surface of the recording paper on the paper feed tray 14. In this state, the paper feed roller 25 rotates. A frication force produced between the roller surface of the paper feed roller 25 and the recording paper feeds the topmost recording paper to the separation tilt plate 21. The front end of this recording paper comes into contact with the separation tilt plate 21, and the recording paper is guided upward and fed to the transport path 22. When feeding the topmost recording paper by the paper feed roller 25, the recording paper immediately below the topmost recording paper may be fed together by friction, an electrostatic function, etc. However, this recording paper is stopped by coming into contact with the separation tilt plate 21.

The transport path 22 is partitioned by an outer guide surface and an inner guide surface facing each other with a predetermined distance therebetween, at locations other than a location where the image recoding section 23, etc. is mounted. In this complex machine 10, the outer guide surface is composed of the inner wall surface of the frame of the complex machine 10, and the inner guide surface is composed of the surface of a guide member provided in the frame of the complex machine 10. Moreover, a transport roller may be provided at a location where the transport path 22 is especially curved. Although the transport roller is not shown in FIG. 2, it may be mounted freely rotatably in the width direction of the transport path 22 (direction perpendicular to the plane of the paper in FIG. 2) as the direction of the center axis of rotation. The transport roller is mounted so that the roller surface is exposed in the outer guide surface or the inner guide surface. With this rotation roller, the recording paper is smoothly transported in contact with the guide surface even in a location where the transport path 22 is curved.

Figure 3:
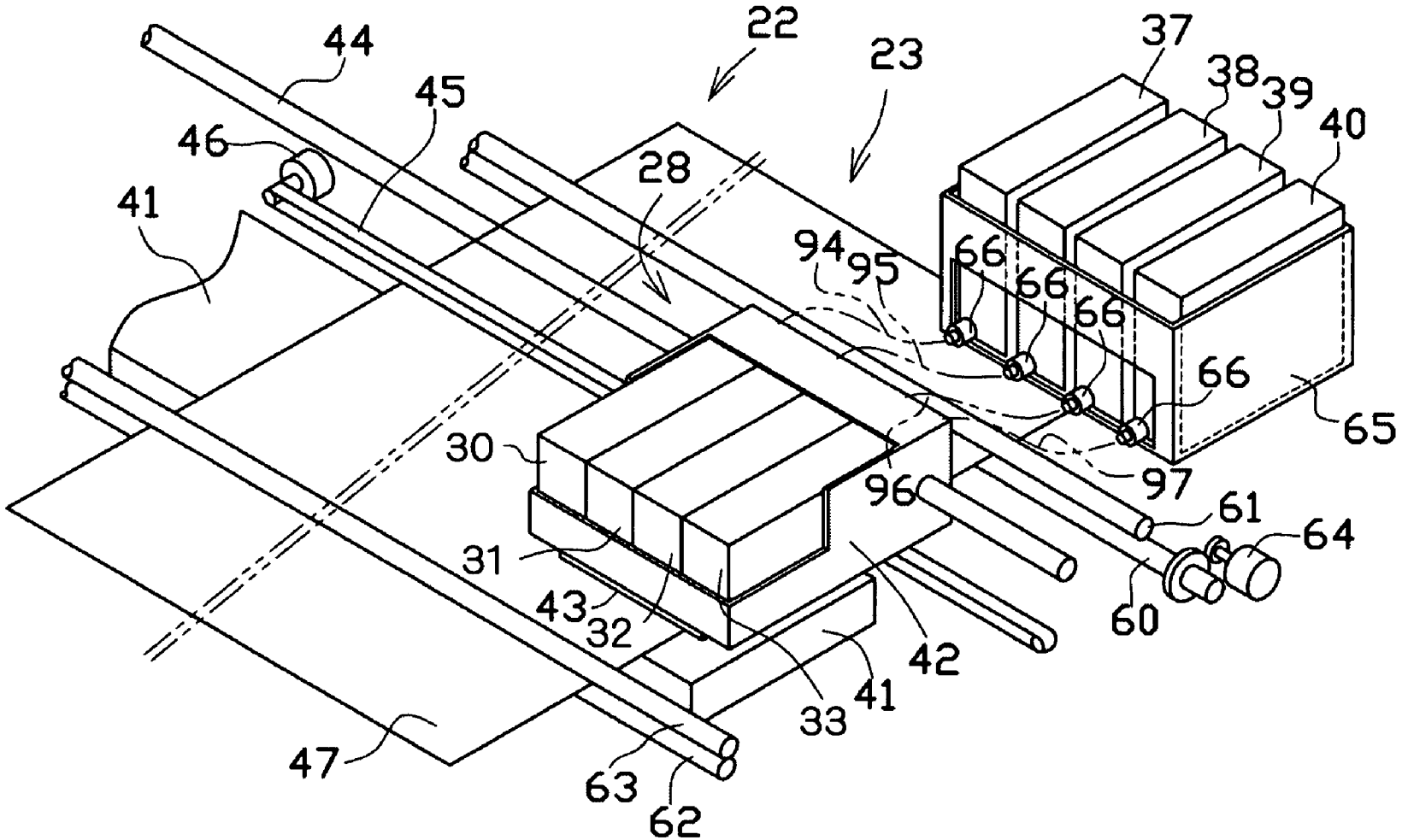
FIG. 3 is a perspective view schematically showing the structure of an image recording section of the complex machine according to the first embodiment.
Figure 4:
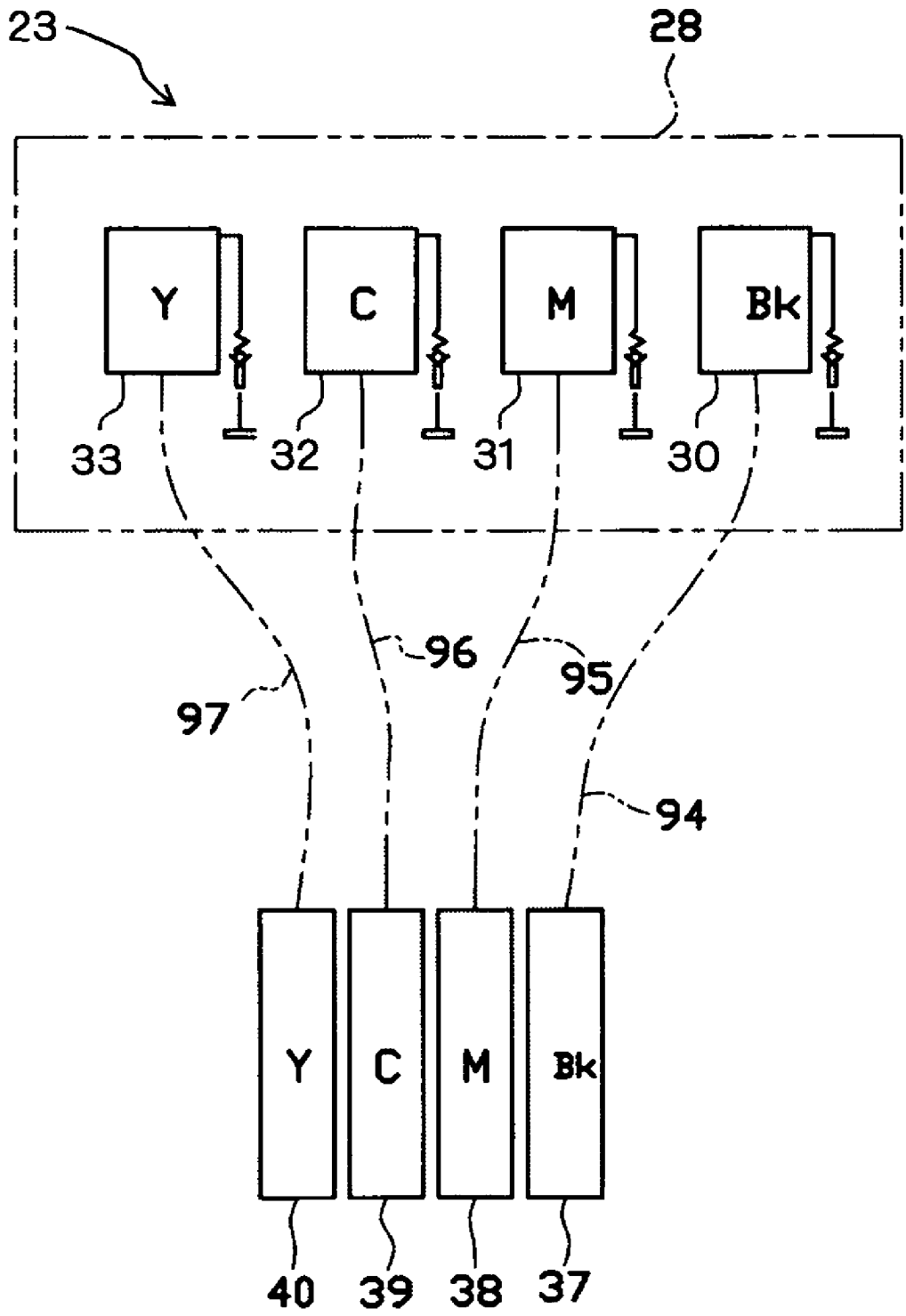
FIG. 4 is a block diagram schematically showing the structure of an image recording section of the complex machine according to the first embodiment.

As described above, the image recording section 23 is located on the downstream side after the transport path 22 makes a U turn from the lower side to the upward side. FIG. 3 is a perspective view schematically showing the structure of the image recording section 23, and FIG. 4 is a block diagram schematically showing the structure of the image recording section 23.

As shown in FIGS. 2 and 3, a drive roller 60 and a press roller 61 are provided on the upstream side of the image recording section 23. The drove roller 60 and press roller 61 sandwich recording paper 47 transported along the transport path 22, and send it onto the platen 41. On the other hand, a paper discharge roller 62 and a press roller 63 are provided on the downstream side of the image recording section 23. The paper discharge roller 62 and press roller 63 sandwich and transport the recorded recording paper 47. The drive roller 60 is driven to rotate by a motor 64, and the paper discharge roller 62 is driven to rotate by a similar motor. Thus, the recording paper 47 is fed intermittently by a predetermined line feed width.

The press roller 61 is resiliently forced toward the drive roller 60 to press the drive roller 60 by a predetermined pressing force. Hence, when the recording paper 47 enters between the drive roller 60 and the press roller 61, the press roller 61 resiliently retreats by an amount equal to the thickness of the recording paper 47 and sandwiches the recording paper 47 in cooperation with the drive roller 60. Therefore, the rotation force of the drive roller 60 is certainly transmitted to the recording paper 47. The press roller 63 is arranged in the same manner with respect to the paper discharge roller 62. However, since the press roller 63 is pressed against the recorded recording paper 47, it is preferred that the press roller 63 has a roller surface in the form of spur so as not to deteriorate the image recorded on the recording paper.

By controlling the rotation of the motor 64, the recording paper 47 sandwiched between the drive roller 60 and the press roller 61 is transported intermittently by the predetermined line feed width onto the platen 41. The later-described recording head 43 (inkjet recording head) is caused to slide in the main scanning direction with each line feed of the recording paper 47, and records an image from the front end of the recording paper 47. The recording paper 47 on which image recording has been performed is sandwiched between the paper discharge roller 62 and the press roller 63 from the frond-end side thereof. In other words, the recording paper 47 is transported intermittently by the predetermined line feed width with the front end being sandwiched between the paper discharge roller 62 and press roller 63 and the rear end being sandwiched between the drive roller 60 and press roller 61, and the recording head 43 records the image on the recording paper 47. Further, when the recording paper 47 is transported, the rear end of the recording paper 47 passes through the drive roller 60 and press roller 61. Consequently, the recording paper 47 is released from the drive roller 60 and the press roller 61, and transported intermittently by the predetermined line feed width by the paper discharge roller 62 and press roller 63. In this case, the recording head 43 also records the image on the recording paper 47. After the image has been recorded in a predetermined area of the recording paper 47, the paper discharge roller 62 is continuously driven to rotate, and the recording paper 47 sandwiched between the paper discharge roller 62 and press roller 63 is discharged onto the paper discharge tray 15.

Figure 9:
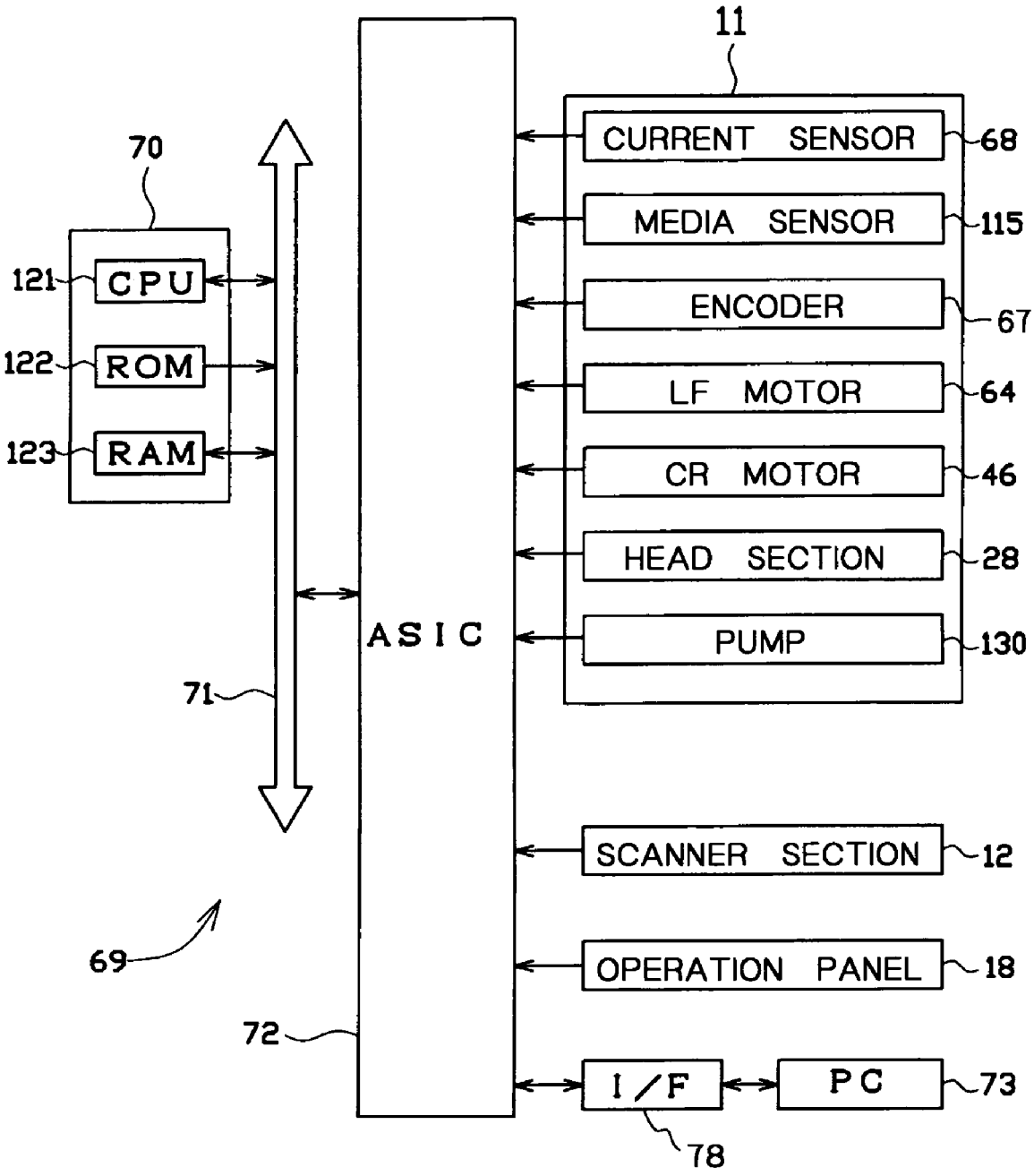
FIG. 9 is a block diagram showing the structure of a controller of the complex machine according to the first embodiment.
Figure 10:
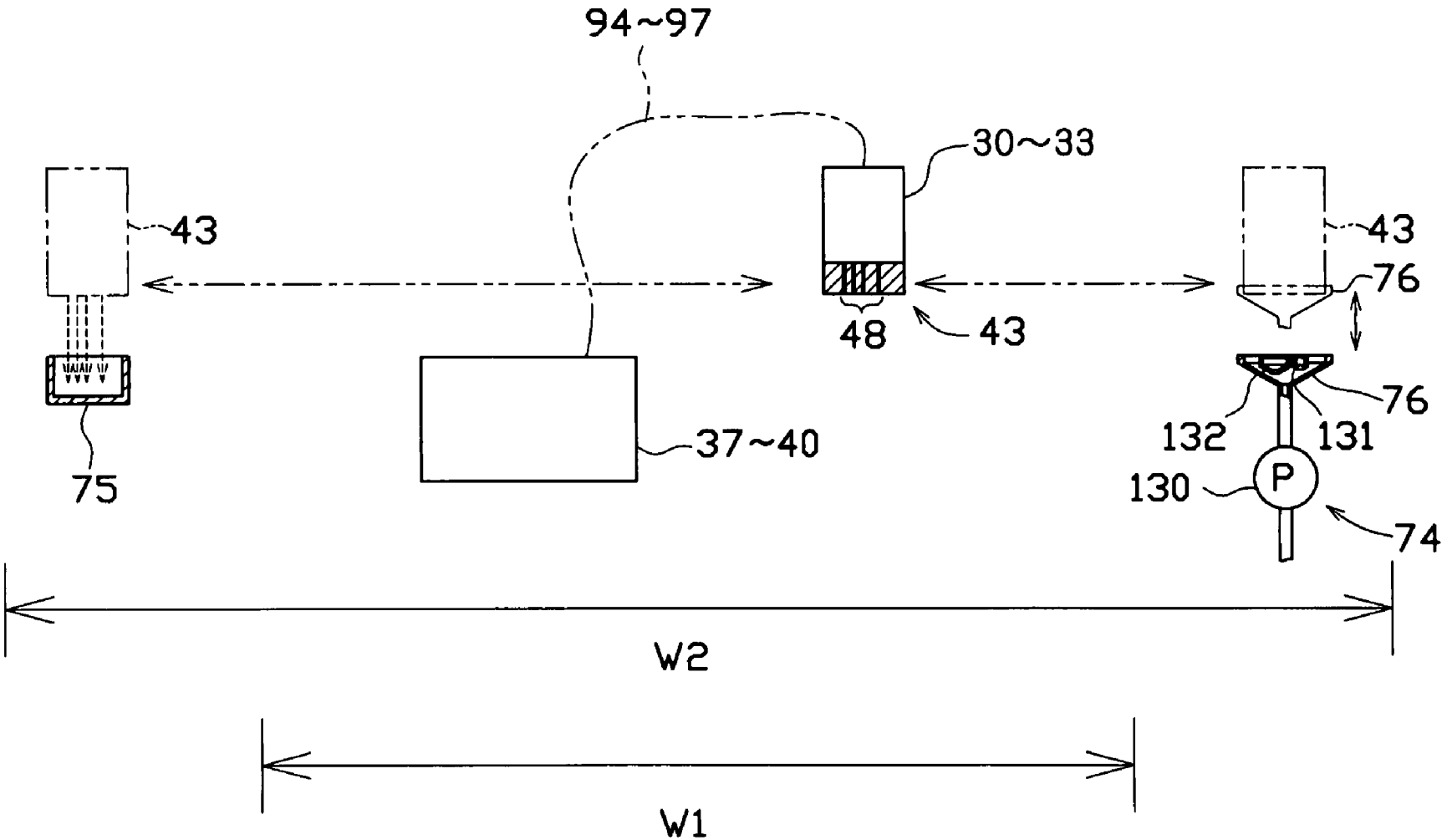
FIG. 10 is a view schematically showing ink supply channels and the operation position of the recording head in the complex machine according to the first embodiment.

As shown in FIGS. 2 to 4, the image recording section 23 comprises a head section 28, a platen 41 placed to face the head section 28, cartridge-type ink tanks 37 to 40 in which inks are stored in advance, and a pump 130 for supplying the inks to the head section 28 from the respective ink tanks 37 to 40 (see FIG. 10). The description of the pump 130 will be given later. Moreover, this complex machine 10 comprises a controller 69 (see FIG. 9) for controlling the operations of the printer section 11, scanner section 12 and other sections of the complex machine 10, independently of the printer section 11 and the scanner section 12. The structure of this controller 69 will also be described in detail later.

The ink tanks 37 to 40 are not necessarily be of cartridge type if they can store inks. In this embodiment, four ink tanks 37 to 40 are provided and store four color inks (black (Bk), magenta (M), cyan (C), yellow (Y)) in advance. The image recording section 23 is for recording an image on the recording paper 47 transported on the platen 41. Specifically, when the head section 28 slides in the main scanning direction while discharging the respective inks of black (Bk), magenta (M), cyan (C) and yellow (Y) supplied from the ink tanks 37 to 40, the image is recorded on the recording paper 47.

The ink tanks 37 to 40 are connected to connection tubes 94 to 97, respectively, made of flexible tubes. As to be described later, the head section 28 slides in the left and right directions in FIG. 4. The connection tubes 94 to 97 have flexibility and a sufficient length. Therefore, the connection tubes 94 to 97 can deform to smoothly follow the slide of the head section 28.

As shown in FIG. 3, the head section 28 comprises the recording head 43, scanning carriage 42, and sub-tanks 30 to 33. The respective sub-tanks 30 to 33 are held on the scanning carriage 42. The sub-tanks 30 to 33 are for temporarily storing the inks supplied from the ink tanks 37 to 40. The recording head 43 is also held on the scanning carriage 42. The recording head 43 is arranged to be exposed from the lower surface of the scanning carriage 42. The inks temporarily stored in the sub-tanks 30 to 33 are supplied to the recording head 43, and discharged as ink droplets from the recording head 43. The scanning carriage 42 is supported by a guide shaft 44, and can slide along the guide shaft 44. An endless belt 45 is attached to the scanning carriage 42. A belt drive motor 46 is connected to the endless belt 45 through a pulley, and the head section 28 slides in the main scanning direction when the belt drive motor 46 is activated.

Although not shown in the drawings, a position sensor (typically, an encoder 67 (see FIG. 9)) is provided on the frame of the complex machine 10. The encoder 67 detects the position of the scanning carriage 42 on the platen 41, and transmits the position data (voltage value) to the controller 69. As to be described later, a CPU 121 of the controller 69 (see FIG. 9) calculates the position of the scanning carriage 42 on the platen 41, based on the position data. Therefore, when the scanning carriage 42 slides, the relative position of the recording head 43 with respect to the recording paper 47 is known by the controller 69.

Figure 5:
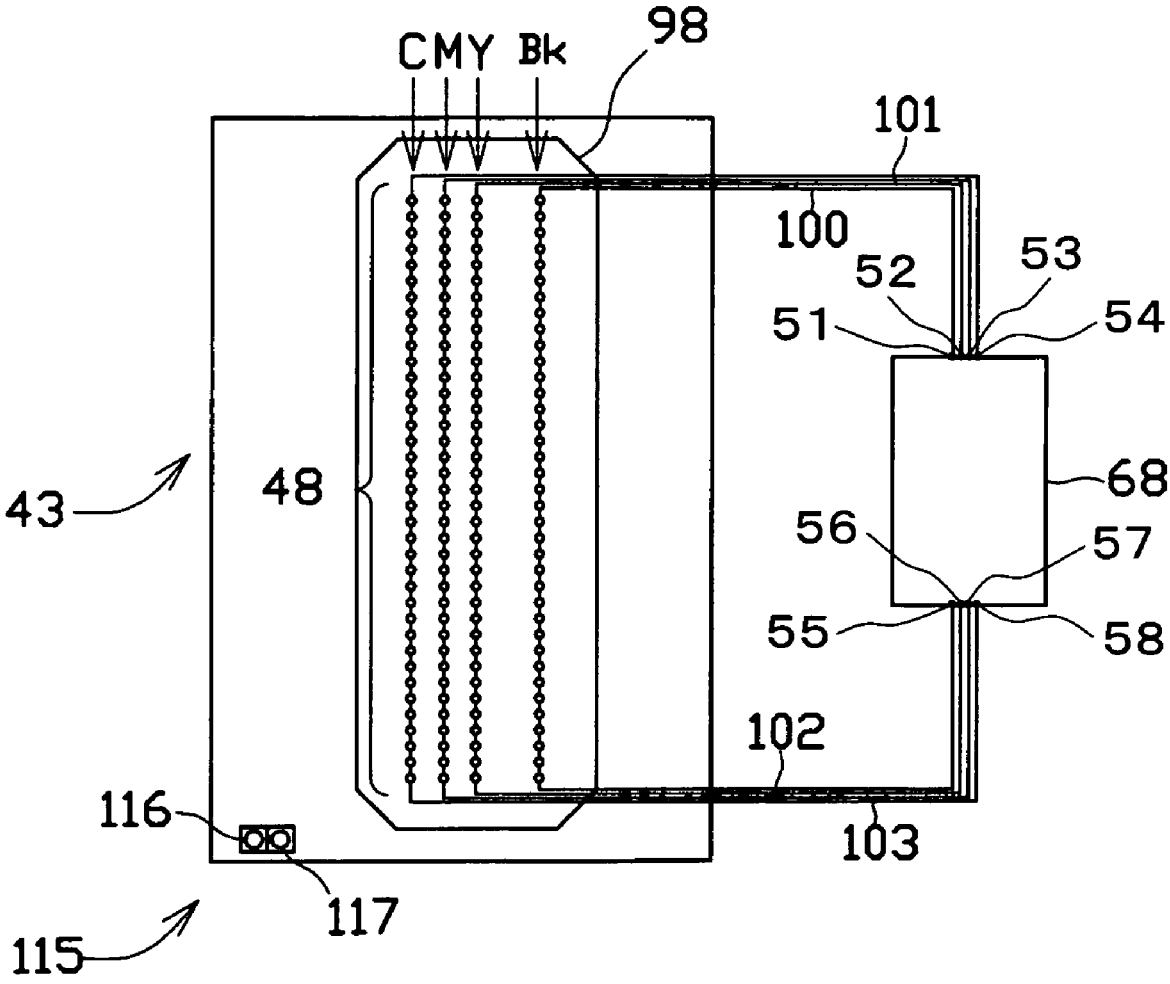
FIG. 5 is a bottom view of a recording head of the complex machine according to the first embodiment.
Figure 6:
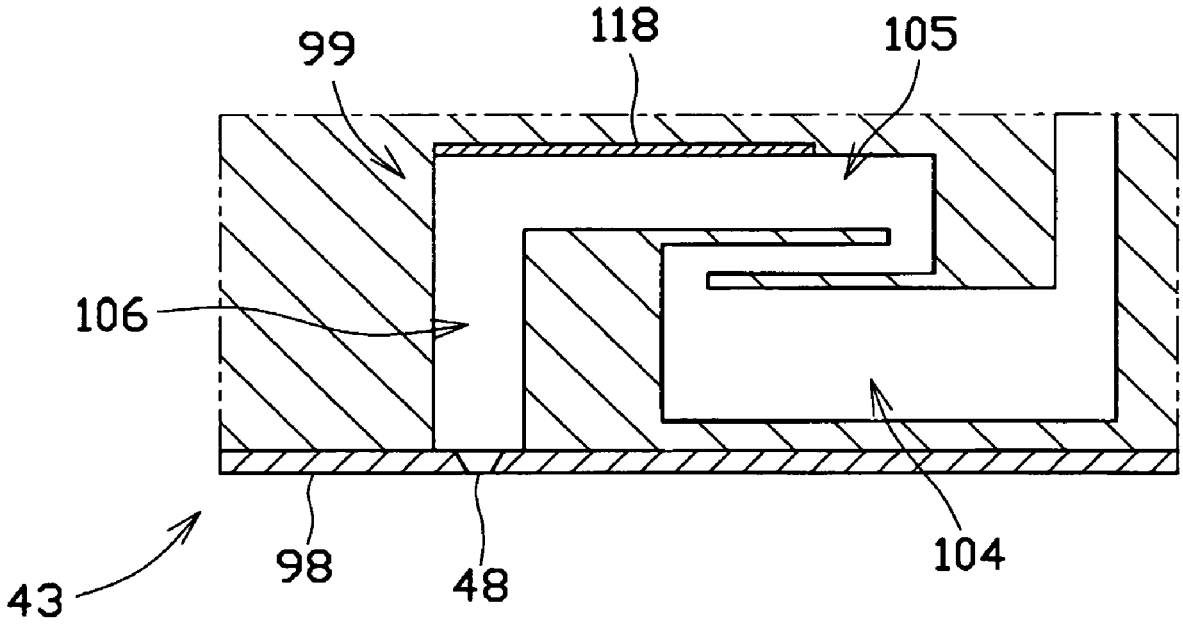
FIG. 6 is an enlarged cross sectional view of the recording head of the complex machine according to the first embodiment.
Figure 7:
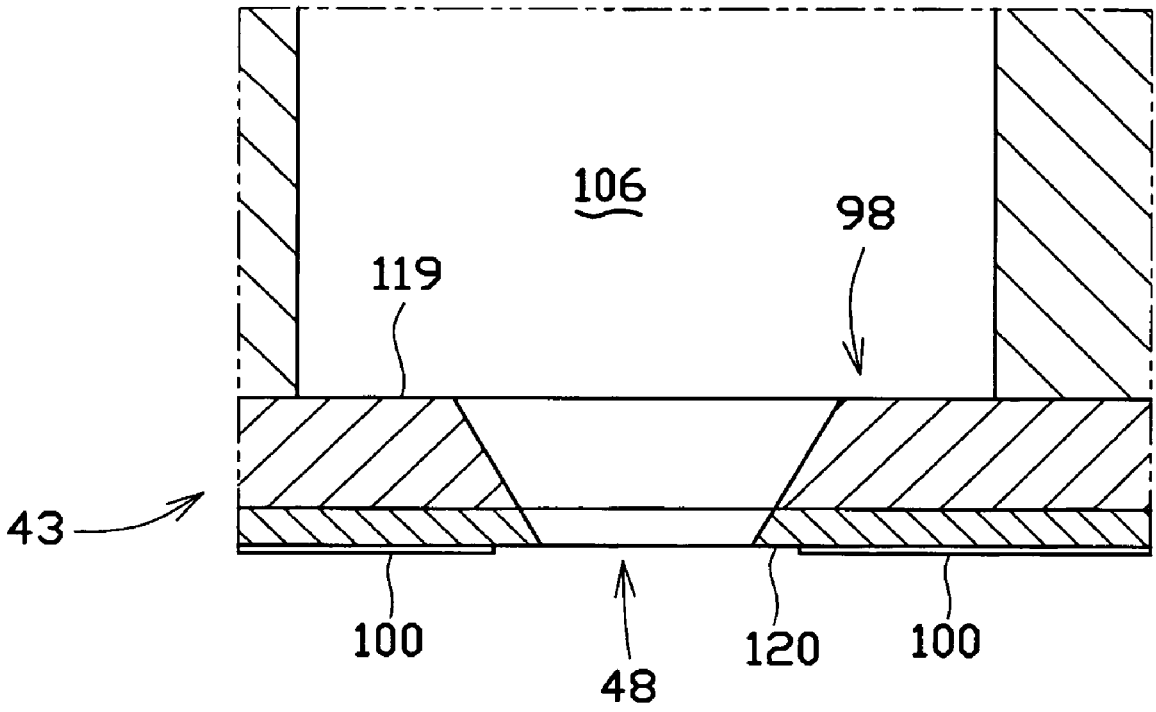
FIG. 7 is an enlarged cross sectional view of the essential section in FIG. 6.
Figure 8:
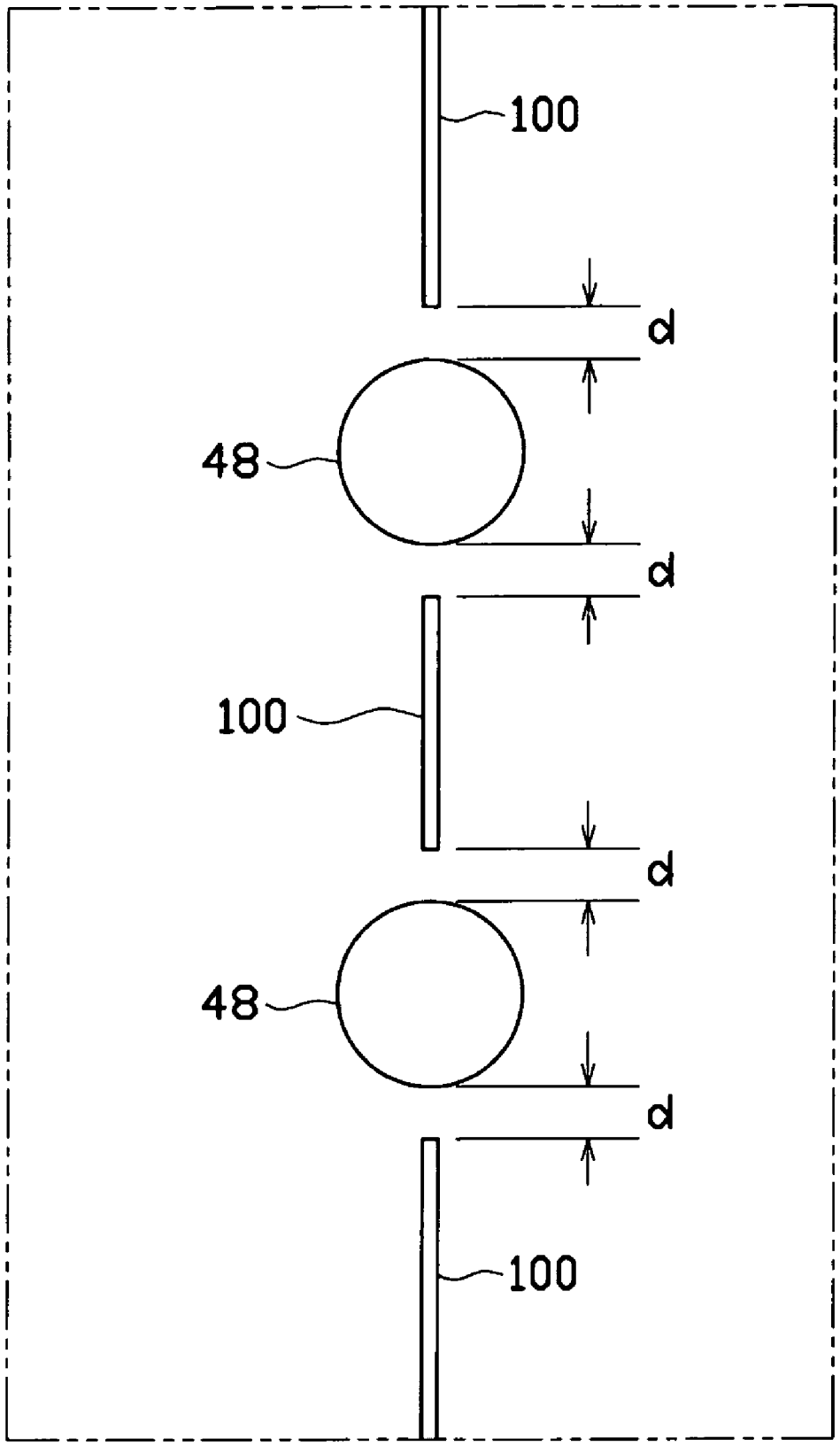
FIG. 8 is an enlarged view of the essential section in FIG. 5.

FIG. 5 is a bottom view of the recording head 43. FIG. 6 is an enlarged cross sectional view of the recording head 43. FIGS. 5 and 6 schematically show the detailed structure of the recording head 43. FIG. 7 is an enlarged cross sectional view of the essential section in FIG. 6, and FIG. 8 is an enlarged view of the essential section in FIG. 5.

As shown in FIGS. 5 and 6, the recording head 43 comprises a main body 99 (recording head main body) including a nozzle plate 98 and electrodes 100 to 103 provided on the nozzle plate 98. A current sensor 68 (current detecting means) for measuring the current value flowing in the respective electrodes 100 to 103 is provided on the complex machine 10, includes a plurality of connection terminals 51 to 58 arranged on the scanning carriage 42, and is connected to the electrodes 100 to 103 through the connection terminals 51 to 58. For the current sensor 68, a known sensor is employed. For example, the current sensor 68 incorporates a power source for applying a predetermined voltage to the respective electrodes 100 to 103, and detects the current flowing in the respective electrodes 100 to 103. A determination is made based on the current value detected by the current sensor 68 as to whether or not a conductive state occurs between the respective electrodes 100 to 103. In this embodiment, the controller 69 functions as determining means for determining whether or not a conductive state occurs between the respective electrodes 100 to 103.

The main body 99 comprises a manifold 104, a cavity 105, and a descender 106 in addition to the nozzle plate 98. The nozzle plate 98 is provided with a plurality of nozzle holes 48. The manifold 104, cavity 105 and descender 106 are integrally formed as an ink flow channel. The descender 106 and cavity 105 are provided for each nozzle hole 48. The manifold 104 divides the ink guided from the sub-tanks 30 to 33 to the respective nozzle holes 48. The manifold 104 is connected to the sub-tanks 30 to 33. A plurality of cavities 105 corresponding to the respective nozzle holes 48 are provided on the downstream side of the manifold 104. Each cavity 105 can easily deform in a resilient manner, and has a piezo element 118 as a piezoelectric element on the upper surface thereof. With a deformation of the piezo element 118, the cavity 105 deforms, and the ink in the cavity 105 is sent toward the descender 106. The descender 106 is attached to the nozzle plate 98. The ink sent from the cavity 105 is pushed out through the nozzle hole 48. Note that since the inks are temporarily stored in the sub-tanks 30 to 33, an air bubble generated in the inks is removed, thereby preventing an air bubble from entering the downstream side from the manifold 104.

As shown in FIG. 5, in this embodiment, a plurality of nozzle holes 48 are arranged. Moreover, the nozzle holes 48 are arranged in four rows in the vertical direction according to the colors of the inks. In FIG. 5, the "vertical direction" is the transport direction of the recording paper 47. The nozzle holes 48 located on the extreme right end in FIG. 5 correspond to the black ink (Bk), and the black ink (Bk ink) is discharged from these nozzle holes 48. Three rows of nozzles holes 48 are provided adjacent to these nozzle holes 48 for the Bk ink. The nozzles holes of these rows correspond to yellow ink (Y ink), magenta ink (M ink), and cyan ink (C ink), respectively, and the Y ink, M ink and C ink are discharged from the respective nozzle holes 48. In short, the recording head 43 can discharge four color inks. Note that, in FIG. 6, although the plurality of nozzle holes 48 arranged in the vertical direction is illustrated only in one row for the purpose of simplifying the explanation, in actual, the plurality of nozzle holes 48 arranged in the vertical direction are arranged in four rows in the left and right directions in FIG. 6.

The scanning carriage 42 comprises a media sensor 115 (see FIG. 5). This media sensor 115 is for detecting the existence and an end position of the recording paper transported in the transport path 22. The media sensor 115 includes a light source 116 and a light receiving element 117. The light source 116 can emit light downward. The light emitted from this light source 116 is irradiated on the front surface of the recording paper 47 transported toward the head section 28. When the recording paper 47 has not been transported onto the platen 41, the light is irradiated on the platen 41. The light irradiated on the recording paper 47 or the platen 41 is reflected. The light receiving element 117 receives this reflected light, and gives an output according to the received light amount. The value of this output is expressed by a so-called AD value (voltage value). By sliding the scanning carriage 42 as described above, the media sensor 115 scans over the platen 41. Then, according to a change in the AD value, the existence of the recording paper 47 on the platen 41 and the position of an end of the recording paper 47 are detected.

Each of the sub-tanks 30 to 33 (see FIG. 3) corresponding to the respective color inks (Bk, Y, M, C) has a fitting section, not shown. One ends of the above-mentioned connection tubes 94 to 97 are connected to the fitting sections. As shown in FIG. 3, the other ends of the connection tubes 94 to 97 are connected to the ink tanks 37 to 40, respectively. Connection sections 66 to which the other ends of the connection tubes 94 to 97 are connected are provided in the lower part of the respective ink tanks 37 to 40, and the other ends of the connection tubes 94 to 97 are connected to the respective connection sections 66. More specifically, the ink tank 37 and the sub-tank 30 are connected with the connection tube 94, the ink tank 38 and the sub-tank 31 are connected with the connection tube 95, and the ink tank 39 and the sub-tank 32 are connected with the connection tube 96, and the ink tank 40 and the sub-tank 33 are connected with the connection tube 97. The ink tanks 37 to 40 are held by a holder 65. As described above, the ink tanks 37 to 40 store the Bk ink, M ink, C ink, and Y ink, respectively. When the pump 130 (see FIG. 10) is activated, the Y ink is drawn from the ink tank 40 and sent to the sub-tank 33 through the connection tube 97. Similarly, the C ink is supplied from the ink tank 39 to the sub-tank 32, the M ink is supplied from the ink tank 38 to the sub-tank 31, and the Bk ink is supplied from the ink tank 37 to the sub-tank 30. As described above, each ink stored temporarily in each of the sub-tanks 30 to 33 flows in the manifold 104, cavity 105 and descender 106, and is then discharged as an ink droplet from the nozzle hole 48 with a deformation of the piezo element 118.

As shown in FIG. 7, the nozzle plate 98 is produced in a plate form, and has two-layer structure. Specifically, the nozzle plate 98 comprises an insulating material 119 (insulating layer) placed on the descender 106 side, and a water repellent film 120 (water repellent layer) placed on the outside of the insulating material 119. The insulating material 119 is made of, for example, polyimide, and the water repellent film 120 is made of, for example, a fluorine-based resin, etc. As shown in FIGS. 7 and 8, the electrodes 100 are arranged on the front surface of the nozzle plate 98, that is, on the outside of the water repellent film 120. Moreover, the electrodes 100 are arranged adjacently with the nozzle hole 48 therebetween.

As shown in FIG. 8, the electrode 100 is separated from the edge of the nozzle hole 48 by a predetermined distance d. The predetermined distance d is set between 1 μm and 5 μm. However, the predetermined distance d is not limited to the range between 1 μm and 5 μm, and can be set within a range of approximately 1 μm and 5 μm. Moreover, as shown in FIG. 5, the electrodes 100 are arranged to connect the nozzle holes 48 in series. Note that although the electrode 100 is placed corresponding to the nozzle hole 48 for discharging the Bk ink, the electrodes 101 to 103 are placed corresponding to the nozzle hole 48 for discharging the Y ink, the nozzle hole 48 for discharging the M ink, and the nozzle hole 48 for discharging the C ink, respectively. Similarly to the electrodes 100, the electrodes 101 to 103 are arranged to connect the respective nozzle holes 48 in series.

FIG. 9 is a block diagram showing the structure of the controller of the complex machine 10.

As shown in FIG. 9, the controller 69 comprises a central processing section 70. The central processing section 70 includes a CPU (Central Processing Unit) 121, a ROM (Read Only Memory) 122, and a RAM (Random Access Memory) 123. The central processing section 70 is connected through a bus 71 and ASIC (Application Specific Integrated Circuit) 72 to the printer section 11 including various kinds of sensors (the media sensor 115, the electrodes 100 to 103, etc.), the scanner section 12, the operation panel 18, etc. so that it can transmit and receive data. As described above, this controller 69 functions as the determining means.

The ROM 122 stores computer programs for controlling the various operations of the complex machine 10. The RAM 123 is used as a memory area or a work area for temporarily storing various kinds of data necessary for the CPU 121 to execute the programs. According to the computer program, the CPU 121 performs a predetermined calculation based on the information given by the current sensor 68. Hence, the conductive state between the respective electrodes 100 to 103 is determined based on the current value detected by the current sensor 68. Moreover, whether or not the recording paper 47 exists on the platen 41 is determined based on the information (AD value) transmitted from the media sensor 115. Further, the CPU 121 performs various kinds of calculations based on the information given by other various sensors. According to an instruction from the CPU 121, the ASIC 72 outputs a signal for driving the motor 64 (LF motor), the belt drive motor 46 (CR motor), the pump 130 for drawing the inks from the ink tanks 37 to 40, the head 28, etc, thereby totally controlling the operations of the printer section 11 and scanner section 12.

The complex machine 10 receives an input from the operation panel 18, and is connected to a personal computer (PC) 73, for example, and can record an image and document on the recording paper 47 based on the image data and document data transmitted from the computer 73. Therefore, the complex machine 10 also comprises an interface (I/F) 78 for transmitting and receiving data to/from the personal computer 73. Note that the structure of the controller 69 illustrated in this embodiment is one example, and thus it is, of course, possible to adopt other structure if it is a controller for performing the later-described control.

FIG. 10 is a view schematically showing ink supply channels through which the inks are supplied from the ink tanks 37 to 40 to the recording head 43 through the sub-tanks 30 to 33, and the operation position of the recording head 43.

The inks supplied from the ink tanks 37 to 40 are stored in the sub-tanks 30 to 33, and air bubbles in the inks are caught as described above. Moreover, as described above, this ink goes through the cavity 105 and descender 106 from the manifold 104 (see FIG. 4) and is discharged as an ink droplet from the nozzle hole 48. By sliding the recording head 43 in an image recording range W1 while discharging the ink droplets in this manner, the image is recorded on the recording paper 47 transported under the recording head 43.

As shown in FIG. 10, a purge mechanism 74 and a waste ink tray 75 are provided at positions located outside the image recording range W1 of the recording head 43 and on both ends of a scannable range W2. In this embodiment, the purge mechanism 74 comprises the above-mentioned pump 130. By activating the pump 130, air bubbles and foreign objects are sucked and removed from the nozzle holes 48 of the recording head 43. Moreover, when the recording head 43 slides to the right end (purge position) in the scannable range W2, a cap 76 of the purge mechanism 74 moves upward and adheres to the lower surface of the recording head 43 to cover the nozzle holes 48.

Provided inside the cap 76 are a black ink cap 131 for covering the nozzle holes 48 of the recording head 43 from which the Bk ink is discharged, and a color ink cap 132 for covering the nozzle holes 48 from which the C ink, M ink and Y ink are discharged. Thus, in a state in which the cap 76 adheres to the lower surface of the recording head 43, the black ink cap 131 covers the nozzle holes 48 from which the Bk ink is discharged, and the color ink cap 132 covers the nozzle holes 48 from which the C ink, M ink and Y ink are discharged. The pump 130 is selectively connected to the black ink cap 131 or the color ink cap 132. Therefore, the nozzle holes 48 from the Bk ink is discharged and the nozzle holes 48 from which the C, M and Y inks are discharged can be separately purged. However, it is also possible to connect the pump 130 to both the black ink cap 131 and the color ink cap 132 simultaneously.

Moreover, when the pump 130 is activated, the inks are sucked from the nozzle holes 48 of the recording head 43, and the Bk ink is drawn into the sub-tank 30 from the ink tank 37 (Bk ink), and the M ink, C ink and Y ink are drawn into the sub-tanks 31 to 33 from the ink tanks 38 to 40, respectively. Further, by activating the pump 130, foreign objects clogging the nozzle holes 48, air bubbles existing in the flow channels on the upstream side of the respective nozzle holes 48, etc. can be sucked and removed. At this time, if the pump 130 is selectively connected to the black ink cap 131 or the color ink cap 132, the removal of foreign objects and air bubbles is separately performed for the nozzle holes 48 corresponding to the Bk ink, or the nozzle holes 48 corresponding to the C, M and Y inks. Note that the control of the belt drive motor 46 for sliding the recording head 43, the movement control of the cap 76, and the drive control of the pump 130 are performed by the controller 69.

In the complex machine 10 according to this embodiment, the ink tanks 37 to 40 are connected to the outside, and the pressure in the ink tanks 37 to 40 is equal to atmospheric pressure. The recording head 43 is located higher than the ink tanks 37 to 40. Therefore, a back pressure (negative pressure) always acts in the sub-tanks 30 to 33, and this back pressure contributes to the formation of the meniscus in the nozzle holes 48. When the recording head 43 discharges ink droplets, the inks in the ink tanks 37 to 40 are supplied continuously to the recording head 43 through the connection tubes 94 to 97 (see FIGS. 3 and 4).

The waste ink tray 75 is for receiving idle discharge of ink from the recording head 43. Such an idle discharge of ink is generally called flushing. During flushing, the recording head 43 is moved to the left end (flashing position) in the scannable range W2, and the respective color inks are idle discharged toward the waste ink tray 75 at this position. By performing such an idle discharge, foreign objects clogging the nozzle holes 48 and air bubbles existing in the flow channels on the upstream side of the nozzle holes 48 can be sucked and removed. Note that the positioning of the purge mechanism 74 and waste ink tray 75 on the left and right sides is not particularly limited, and they may be positioned opposite to the above-mentioned left and right sides in the scannable range W2, or both of them may be positioned on either the left or right side.

In this embodiment, when the scanning carriage 42 is placed on the flashing position (the left end in FIG. 10), the encoder 67 is set to an initial value (original point). However, it may be possible to set the encoder 67 to the original point when the scanning carriage 42 is placed on the purge position (the right end in FIG. 10). In other words, when the scanning carriage 42 is on the purge position or the flushing position, the standard position of the scanning carriage 42 is set. The holder 65 (see FIG. 3) holding the ink tanks 37 to 40 can be set, for example, on the right end in the scannable range W2. However, it may be possible to set the holder 65 on the left end in the scannable range W2, or in the dead space of the frame of the complex machine 10.

Figure 11:
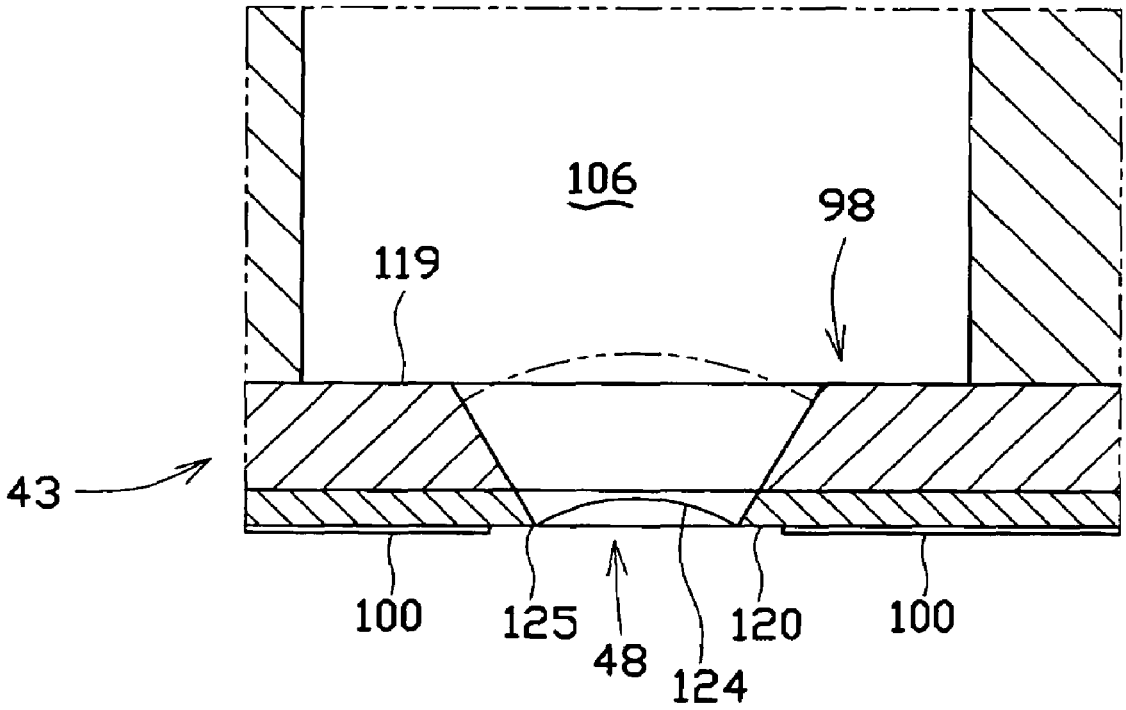
FIG. 11 is an enlarged cross sectional view of the essential section of the recording head of the complex machine according to the first embodiment, showing a state in which the ink forms a normal meniscus.
Figure 12:
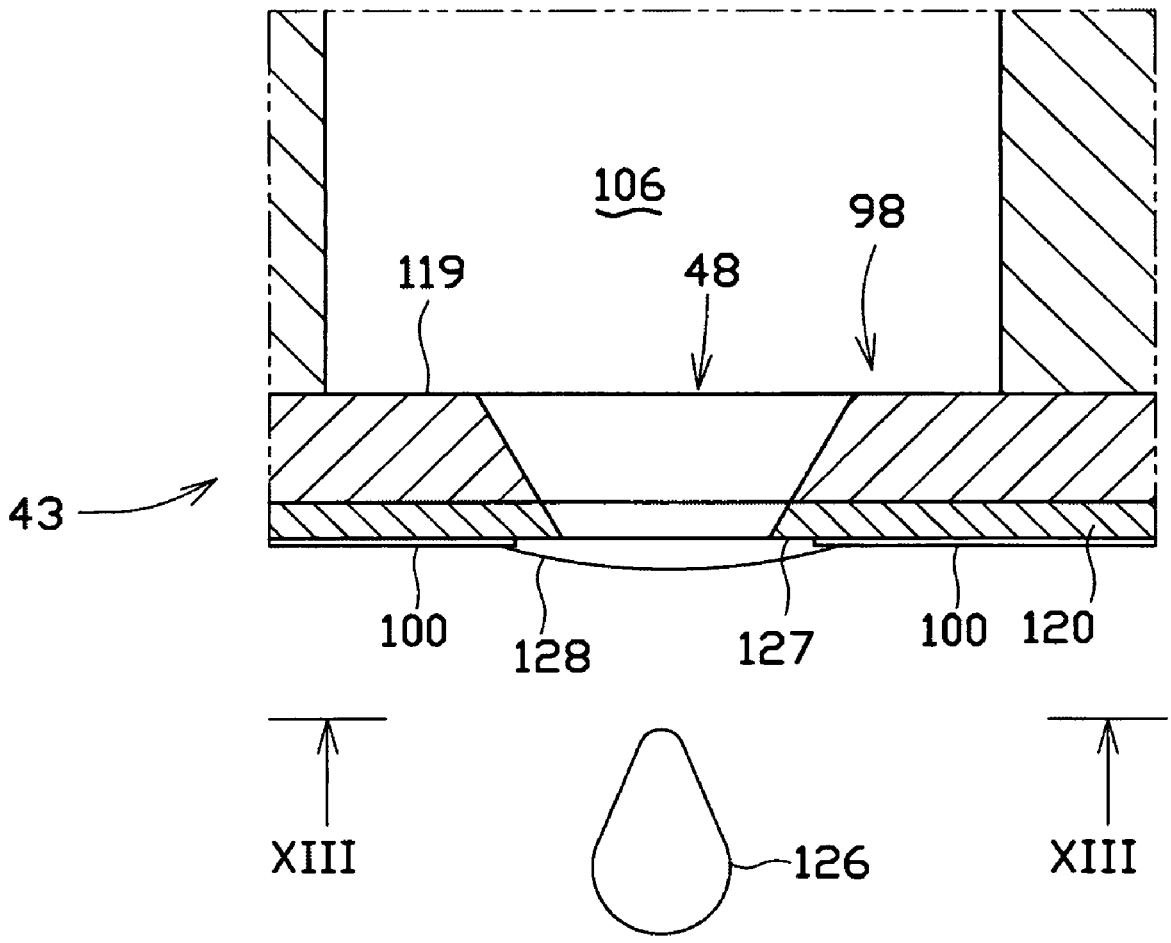
FIG. 12 is an enlarged cross sectional view of the essential section of the recording head of the complex machine according to the first embodiment, showing a state in which an ink droplet was discharged.
Figure 13:
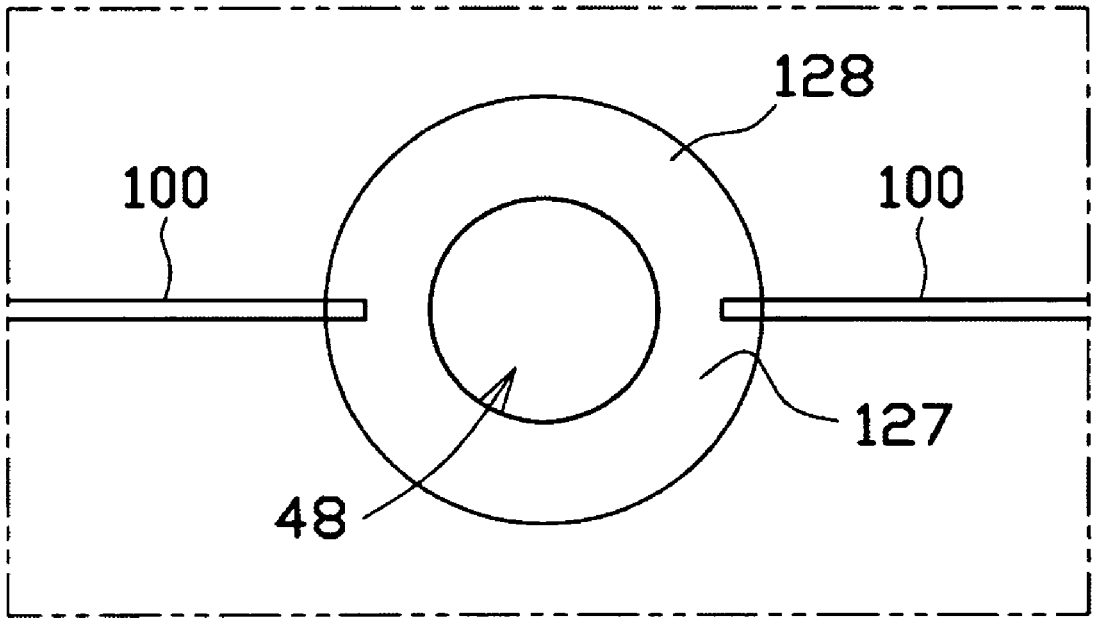
FIG. 13 is a sectional view when viewed from line XIII-XIII in FIG. 12.

FIGS. 11 and 12 are enlarged cross sectional views of the essential section of the recording head 43. FIG. 11 shows a state in which the ink forms a normal meniscus in the nozzle hole 48 before an ink droplet is discharged from the recording head 43. FIG. 12 shows a state at the moment the ink droplet was discharged from the head 43. FIG. 13 is a sectional view when viewed from line XIII-XIII in FIG. 12.

In order to satisfactorily discharge the ink droplet from the recording head 43 when recording an image, a meniscus needs to be formed normally in the nozzle hole 48 and follow the deformation (oscillation) of the piezo element 118 provided in the recording head 43. Here, as shown in FIG. 11, the "normal meniscus" means a state in which an ink liquid surface 124 (meniscus) is formed in a concave curved shape from an outside edge 125 of the nozzle hole 48 to the inner side, and the edge of the ink liquid surface 124 is positioned on the outside edge 125 of the nozzle hole 48. When the ink is discharged as an ink droplet from the nozzle hole 48 in a state in which the normal meniscus 124 is formed, the ink behaves as follows. Specifically, with the deformation of the piezo element 118, the normal meniscus 124 further retreats to the inner side of the nozzle hole 48 once as shown by an alternate long and two short dashes line in FIG. 11, and is then pushed out as if it is shot from the nozzle hole 48 with the recovery of deformation of the piezo element 118.

If an air bubble has already entered the nozzle hole 48 before the ink droplet is discharged, the liquid surface (meniscus) of the ink retreats to the inner side of the nozzle hole 48.

If the meniscus retreats to the inner side of the nozzle hole 48 before the ink droplet is discharged as described above, the ink can not be ejected as an ink droplet from the nozzle hole 48. On the other hand, if an air bubble exists in the flow channel on the upstream side of the nozzle hole 48 before the ink droplet is discharged, the air bubble functions as a kind of cushioning material when the piezo element 118 deforms. More specifically, the pressure of the ink changes with the deformation of the piezo element 118, and the liquid surface (meniscus) of the ink retreats into the nozzle hole 48 once. However, since the air bubble exists, the change in the ink pressure only deforms the air bubble, and can not cause the meniscus to retreat to the inner side of the nozzle hole 48. Thus, even when the normal meniscus 124 is formed before discharging the ink droplet, if an air bubble exists, this ink can not be ejected as an ink droplet from the nozzle hole 48.

However, when the normal meniscus 124 is formed in the nozzle hole 48 before discharging the ink droplet and the meniscus 124 follows the deformation (oscillation) of the piezo element 118, the ink shows the following behavior. Specifically, first, with the deformation of the piezo element 118, the meniscus 124 retreats to the inner side of the nozzle hole 48. Thereafter, when the deformation of the piezo element 118 recovers, the ink forms a column shape and sticks out of the nozzle hole 48, and further a part of the columnar ink separates and is ejected as an ink droplet 126 from the nozzle hole 48.

However, after a part of the columnar ink separates as the ink droplet 126, the columnar ink spreads in the radial direction due to a reaction of the separation of the ink droplet 126, and adheres to the periphery of an opening edge 127 of the nozzle hole 48. As described above, since the back pressure (negative pressure) acts in the sub-tanks 30 to 33, the columnar ink after the separation of the ink droplet 126 retreats again to the nozzle hole 48 side. In other words, since the inside of the nozzle hole 48 always has a negative pressure (equal to or lower than the atmospheric pressure), the columnar ink retreats as if it is pulled into the nozzle hole 48. Then, the ink adhering to the periphery of the opening edge 127 of the nozzle hole 48 also retreats into the nozzle hole 48 as if it is pulled by the columnar ink. The ink retreated into the nozzle hole 48 forms the normal meniscus again.

As described above, after the ink droplet 126 is ejected from the nozzle hole 48, a tip 128 of the columnar ink adheres to the periphery of the opening edge 127 of the nozzle hole 48. As shown in FIG. 13, since the electrodes 100 are adjacently arranged with the nozzle hole 48 therebetween, the tip 128 of the columnar ink functions as an electrically conductive material for connecting the electrodes 100 together. Therefore, if the tip 128 of the ink adheres to bridge the electrodes 100, a current flows between the electrodes 100. The same can also be said for other electrodes 101 to 103. When the current flows between the electrodes 100 in such a manner, the current sensor 68 detects the current, and the controller 69 determines that a conductive state occurs between the electrodes 100. In other words, the fact that the ink droplet 126 was certainly discharged from the nozzle hole 48 is detected. Note that after the ink droplet 126 is discharged from the nozzle hole 48, since the ink forms a normal meniscus again in the nozzle hole 48 as described above, an insulated state will be detected again after the detection of the current.

Thus, in the complex machine 10 according to this embodiment, since the fact that the ink droplet 126 was certainly discharged is detected when recording an image, if a discharge defect of ink droplet is caused by some reason, this defect is certainly detected even during printing. Therefore, the discharge defect of ink droplet is corrected even during printing.

More specifically, in the complex machine 10 according to this embodiment, as described above, in general, clogging of the recording head 43 is prevented by performing the flushing operation or the purge operation periodically. Typically, the flushing operation is performed immediately before the printing operation, and, during printing, the flushing operation is performed when executing the line feed operation. Thus, since the flushing operation is performed immediately before printing, if the fact or possibility of discharge defect of ink droplet is detected immediately before printing, it is possible to correct the discharge defect or the possibility thereof by occasionally performing the purge operation, etc. Moreover, by periodically performing the flushing operation whenever line feed is performed (or whenever line feed is performed a predetermined number of times) during the printing operation, the discharge defect of ink droplet or the possibility thereof during printing can be detected. In this case, it is also possible to correct the discharge defect or the possibility thereof by occasionally performing the purge operation, etc.

In particular, in this embodiment, as shown in FIGS. 11 and 12, the electrodes 100 are arranged on the front surface of the nozzle plate 98. As described above, when the ink droplet 126 is discharged from the nozzle hole 48, a part of the ink adheres to the periphery of the opening edge 127 of the nozzle hole 48. Therefore, if the electrode 100 is arranged on the front surface of the nozzle plate 98, the ink adhering to the opening edge 127 of the nozzle hole 48 certainly functions as the electrically conductive material, and there is an advantage that a state in which a conductive state occurs between the electrodes 100 is certainly determined.

Moreover, as shown in FIG. 8, the electrode 100 is separated from the edge of the nozzle hole 48 by 1 μm to 5 μm. Therefore, it is possible to prevent an erroneous operation of the current sensor 68 due to contact of the electrode 100 with the normal meniscus before the ink droplet is discharged. More specifically, as shown in FIG. 11, since the edge of the normal meniscus 124 is positioned on the edge of the nozzle hole 48, if the electrode 100 extends to the edge of the nozzle hole 48, the edge of the meniscus 124 comes into contact with the electrode 100, and the current sensor 68 may perform an erroneous operation. However, since the electrode 100 is separated from the edge of the nozzle hole 48 by 1 μm to 5 μm, it is possible to prevent the erroneous operation of the current sensor 68. Further, as described above, when the ink droplet 126 is discharged from the nozzle hole 48, a part of the ink adheres to the periphery of the opening edge 127 of the nozzle hole 48. At this time, the ink usually spreads in a circular shape with a diameter larger than the diameter of the nozzle hole 48 by 10 μm or so. Therefore, the ink adhering to the opening edge 127 of the nozzle hole 48 certainly functions as the electrically conductive material, and a state in which a conductive state occurs between the electrodes 100 is certainly determined.

Moreover, the water repellent film 120 is formed on the front surface of the nozzle plate 98. With this water repellent film 120, the ink spreading once over the front surface of the nozzle plate 98 retreats quickly into the nozzle hole 48 due to the back pressure in the sub-tanks 30 to 33 and the surface tension of the ink. Thus, there is an advantage that the normal meniscus can be quickly formed again after the discharge of the ink droplet 126.

In this embodiment, as shown in FIG. 5, the electrodes 100 are arranged to connect the plurality of nozzle holes 48 in series. Consequently, when the ink is discharged from the respective nozzle holes 48, if a conductive state does not occur between the electrodes 100 for any one of the nozzle holes 48, it is possible to detect the fact that the ink does not adhere to the front surface of the nozzle plate after the discharge of the ink droplet. In other words, the fact that the ink droplet 126 was not ejected normally from all the nozzle holes 48 is detected. Thus, there is an advantage that it is possible to certainly prevent printing defects. In this case, the "series connection" is not limited to only the case where all the nozzle holes 48 in a row of nozzle holes 48 discharging the Bk ink are connected in series. In other words, the "series connection" also includes the case where a plurality of nozzle holes 48 that may discharge ink droplets at the same time are connected in series. For example, when printing is performed on an end of the recording paper 47 transported on the platen 41, ink droplets are not discharged from all the nozzle holes 48 at the same time, but ink droplets are discharged only from a predetermined number of nozzle holes 48 located in a position corresponding to the end. The case where the predetermined number of nozzle holes 48 are connected in series with the electrodes 100 also corresponds to the above-mentioned "series connection".

Additionally, in this embodiment, as shown in FIG. 5, the plurality of nozzle holes 48 are arranged for each color of ink to be discharged. Hence, a failure in ejecting the ink droplet 126 from the nozzle hole 48 is detected for each color. There may be various reasons why the ink droplet was not ejected from the nozzle hole, and the above-mentioned purging, flushing, etc. are performed as a measure to solve this failure. In this case, it is not necessary to perform purging or flushing for all the colors at the same time. As described above, the measure such as purging may be performed for only the nozzle holes 48 corresponding to the Bk ink, or the nozzle holes 48 corresponding to the C, M and Y inks. Thus, there is also an advantage of preventing unnecessary ink waste.

Second Embodiment

Figure 14:
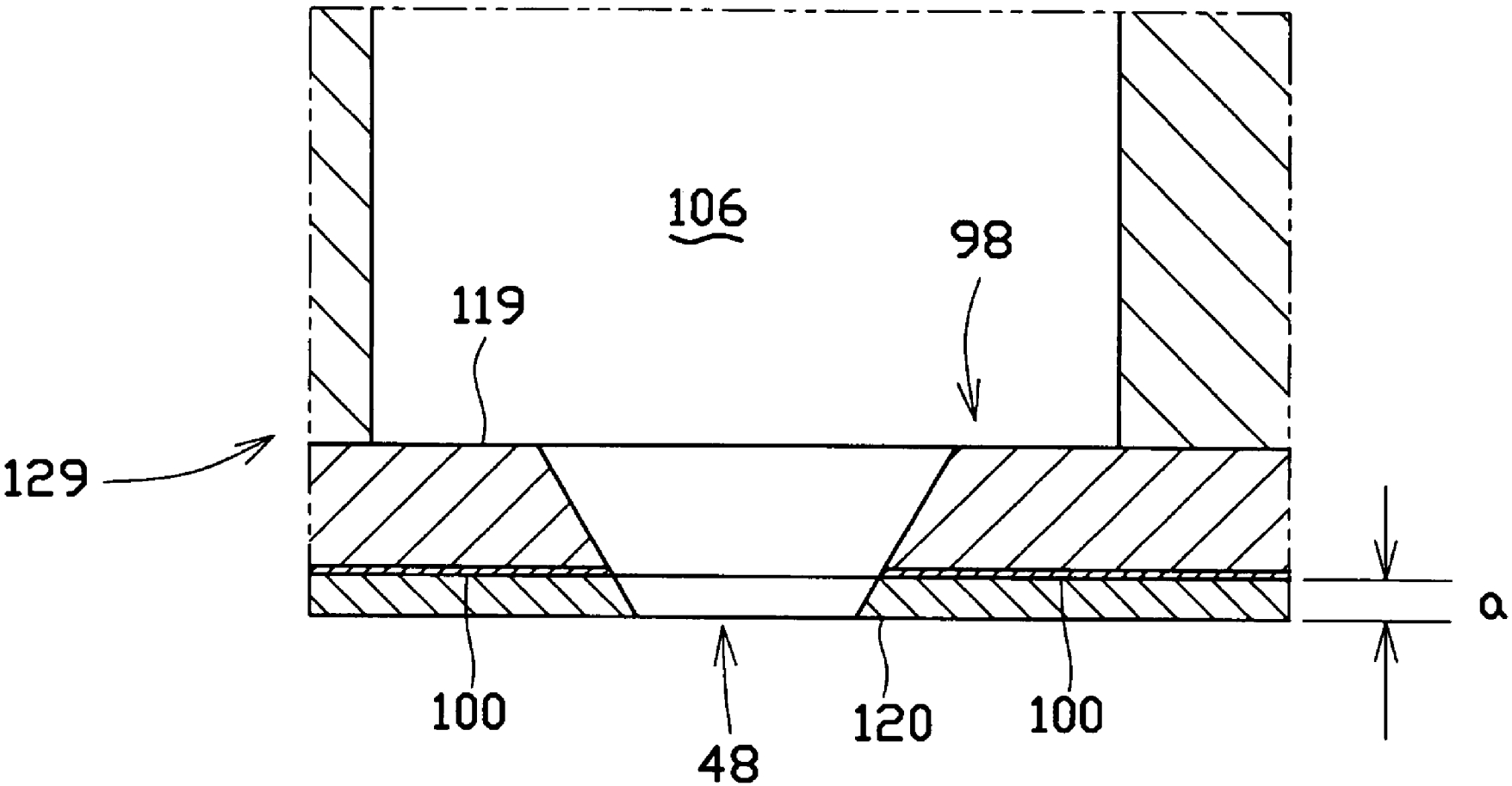
FIG. 14 is an enlarged cross sectional view of the essential section of a recording head according to the second embodiment.
Figure 15:
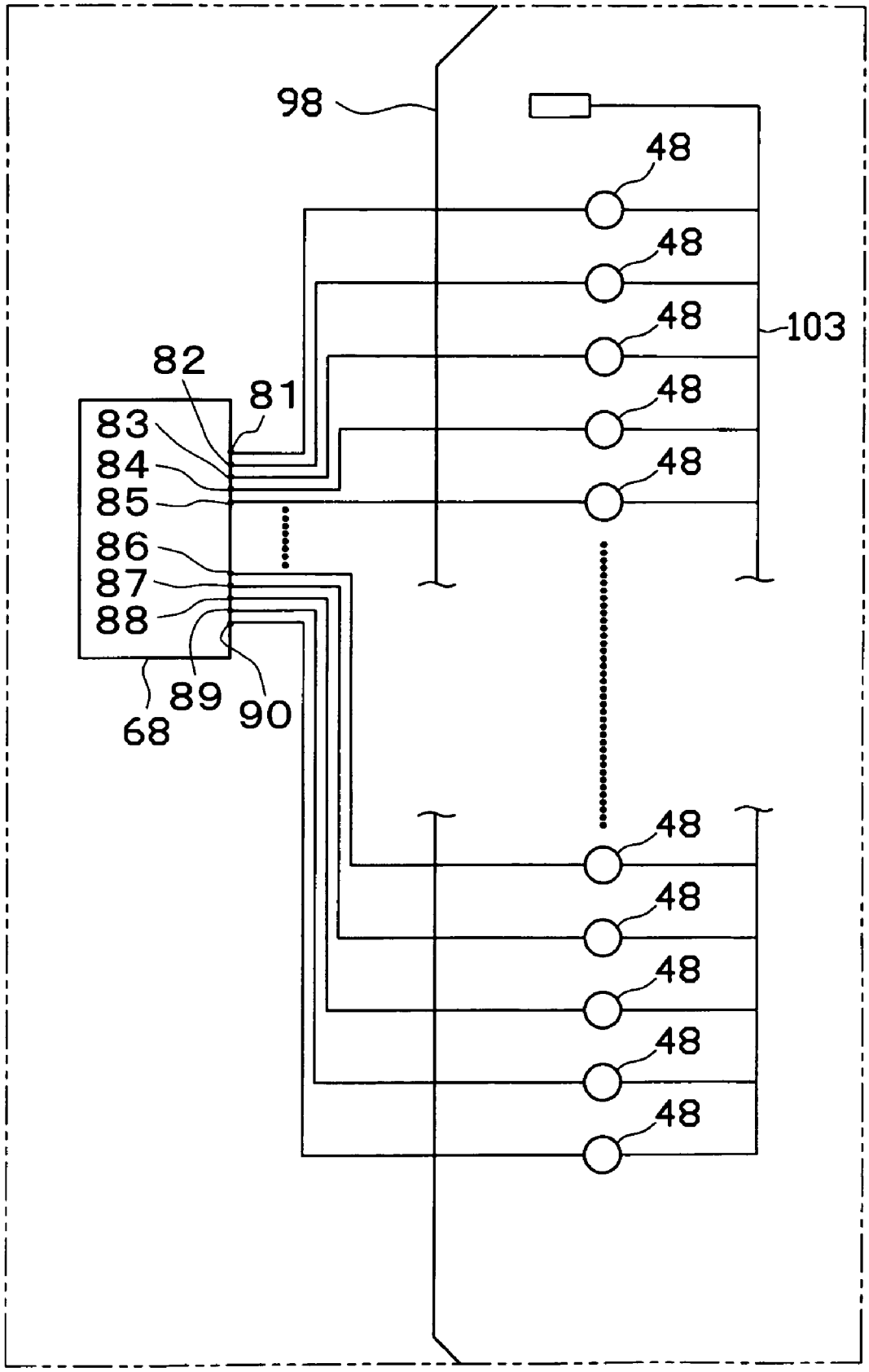
FIG. 15 is a connection diagram of electrodes arranged in the recording head according to the second embodiment.

Next, the second embodiment will be explained. FIG. 14 is an enlarged cross sectional view of the essential section of a recording head 129 according to the second embodiment. FIG. 15 is a connection diagram of electrodes arranged in this recording head 129.

The recording head 129 according to this embodiment differs from the recording head 43 of the first embodiment in that the electrodes 100 to 103 are buried in the nozzle plate 98 in the recording head 129 of this embodiment while the electrodes 100 to 103 are arranged on the front surface of the nozzle plate 98 in the recording head 43, and that the electrodes 100 to 103 of this embodiment are arranged to connect the nozzle holes 48 in parallel while the electrodes 100 to 103 are arranged to connect the nozzle holes 48 in series in the first embodiment. The other structures are the same as those of the complex machine 10 according to the first embodiment.

As shown in FIG. 14, the electrode 100 is sandwiched between the insulating material 119 and the water repellent film 120, and its end is exposed to the inner surface of the nozzle hole 48. More specifically, the electrode 100 is positioned at a distance a from the surface of the nozzle plate 98 toward the inside, and, for example, this distance a can be set between 1 μm and 100 μm. The same can also be said for the electrodes 101 to 103.

As described above, in order to eject the ink droplet 126 from the nozzle hole 48, the meniscus 124 must be formed on the opening edge 127 of the nozzle hole 48 (see FIG. 12). In other words, the above-mentioned normal meniscus 124 must be formed. In this embodiment, since the electrode 100 is positioned at the distance a, the electrode 100 comes into contact with only the normally formed meniscus 124, and a conductive state occurs between the electrodes 100 if the normal meniscus 124 is formed before the ink droplet 126 is ejected from the nozzle hole 48. The same can also be said for the electrodes 101 to 103. In other words, if an abnormal meniscus is formed for some reason, such as the existence of an air bubble, before the ink droplet 126 is ejected from the nozzle hole 48, an insulated state occurs between the electrodes 100 to 103.

As described above, when the piezo element 118 is deformed, the normal meniscus 124 further retreats deep into the nozzle hole 48 once (see FIG. 11). Therefore, the state between the electrodes 100 to 103 changes from the conductive state to the insulated state at this time. Moreover, when the deformation of the piezo element 118 recovers, the ink in the nozzle hole 48 is ejected from the nozzle hole 48 as if it is shot. Accordingly, the state between the electrodes 100 to 103 changes from the insulated state to the conductive state at this time. Further, since the ink returns into the nozzle hole 48 again after the discharge of the ink droplet 126, the conductive state is maintained. Thus, when the current flows between the electrodes 100 to 103, the current sensor 68 detects the current, and the controller 69 determines that the state between the electrodes 100 to 103 has momentarily changed from the conductive state to the insulated state. In other words, it is possible to detect the fact that the meniscus 124 (normal meniscus) capable of discharging an ink droplet is formed in the nozzle hole 48 before and after the discharge of the ink droplet 126.

As shown in FIG. 15, the nozzle holes 48 are connected in parallel with the electrodes 103, and the electrodes 103 are connected to the current sensor 68. In this embodiment, the current sensor 68 has an inner circuit constructed to detect the conductive state between the electrodes 103 arranged for the nozzle holes 48, respectively. Therefore, the current sensor 68 is provided with a plurality of connection terminals 81 to 90, and the electrodes 103 corresponding to the respective nozzle holes 48 are connected to the connection terminals 81 to 90. In FIG. 15, although only the electrode 103 is illustrated for the purpose of simplifying the explanation, in actual, the electrodes 100 to 103 are arranged for the nozzle holes 48 corresponding to the respective ink colors similarly to the first embodiment, and a plurality of nozzle holes 48 corresponding to the respective inks are connected in parallel with the electrodes 100 to 103, respectively. The meaning "parallel connection" is similar to that described in the first embodiment. Specifically, the "parallel connection" is not limited to the case where all the nozzle holes 48 in a row of the nozzle holes 48 discharging each color of ink are connected in parallel, but the "parallel connection" also includes the case where a plurality of nozzle holes 48 that may discharge ink droplets at the same time are connected in parallel. For example, when printing is performed on an end of the recording paper 47 transported on the platen 41, ink droplets are not simultaneously discharged from all the nozzle holes 48, but the ink droplets are discharged only from a predetermined number of nozzle holes 48 located in a position corresponding to the end. The case where the predetermined number of nozzle holes 48 are connected in parallel with the electrodes 100 to 103 also corresponds to the above-mentioned case of "parallel connection".

In this embodiment, before and after the discharge of the ink droplet 126, it is possible to detect the fact that the normal meniscus 124 (the ink surface capable of discharging an ink droplet) is formed in the nozzle hole 48. In other words, it is possible to detect the fact that the normal meniscus was formed before discharging the ink droplet 126, and the meniscus retreated normally into the nozzle hole 48 immediately before the discharge of the ink droplet 126 (the normal behavior of the normal meniscus). Thus, since the state in which the ink droplet 126 can be certainly discharged is detected when recording an image, if there is a possibility that discharge defect of ink droplet may be caused by some factor, this is certainly detected even during printing. Therefore, if there is a possibility of discharge defect of ink droplet, this is corrected even during printing. More specifically, similarly to the first embodiment, the possibility of discharge defect is eliminated during periodical flushing, or by forcefully performing occasional flushing, thereby preventing a discharge defect which may actually occur thereafter in advance.

In this embodiment, the electrodes 100 to 103 are sandwiched between the insulating material 119 and the water repellent film 120. Therefore, a conductive state will never occur between the electrodes 100 to 103 by the ink existing in the flow channel on the upstream side of the nozzle holes 48. Moreover, as described above, the ink that spread once on the front surface of the nozzle plate 98 quickly retreats into the nozzle hole 48 due to the back pressure in the sub-tanks 30 to 33 and the surface tension of the inks. Accordingly, if the normal meniscus performs the normal behavior, the state between the electrodes 100 to 103 certainly changes from the conductive state to the insulated state and to the conductive state, thereby certainly preventing erroneous operations of the current sensor 68 and the controller 69.

In this embodiment, since the electrodes 100 to 103 are arranged to connect a plurality of nozzle holes 48 corresponding to each ink color in parallel, if any one of the electrodes 100 to 103 corresponding to the plurality of nozzle holes 48 does not change to the insulated state when the respective inks are discharged from the nozzle holes 48, the fact that the normal meniscus 124 does not perform the normal behavior is determined. In other words, the fact that the ink droplet 126 is not in a state capable of being ejected from the nozzle hole 48 is detected. Thus, there is an advantage that printing defects are certainly prevented.

Further, in this embodiment, as described above, a plurality of nozzle holes 48 are arranged for each color of ink to be discharged. Hence, the fact that the normal meniscus 124 does not perform the normal behavior, that is, the ink droplet 126 is not in a state capable of being ejected from the nozzle hole 48, is detected for each color. In this case, similarly to the first embodiment, purging or flushing is performed to solve the reason preventing the formation of the normal meniscus. When performing purging or flushing, it is not necessary to perform flushing, etc. for all the colors, and flushing, etc. may be performed for only the nozzle holes 48 corresponding to the color of the ink droplet 126 that was not ejected, thereby preventing unnecessary ink waste.

Third Embodiment

In the above-mentioned embodiments, the current sensor is provided on the complex machine 10, and is connected to the electrodes provided on the recording head through the connection terminals arranged on the scanning carriage. However, the current sensor may be integrally provided on the recording head. The other structures are the same as those of the complex machine 10 according to the above-mentioned embodiments.

In this embodiment, the electrodes are preferably arranged on the front surface of the nozzle plate. As described above, when the ink droplet is discharged from the nozzle hole, a part of the ink adheres to the periphery of the opening edge of the nozzle hole. Therefore, if the electrodes are arranged on the front surface of the nozzle plate, the ink adhering to the opening edge of the nozzle hole certainly functions as an electrically conductive material, and it is possible to certainly determine the fact that a conductive state occurs between the electrodes.

In this embodiment, the electrodes are preferably separated from the edge of the nozzle hole by approximately 1 μm to 5 μm. As described above, when an ink droplet is discharged from the nozzle hole, a part of the ink adheres to the periphery of the opening edge of the nozzle hole. At this time, the ink usually spreads in a circular shape with a diameter larger than the diameter of the nozzle hole by 10 μm or so. Therefore, the ink adhering to the opening edge of the nozzle hole certainly functions as an electrically conductive material, and the fact that a conductive state occurs between the electrodes is certainly determined.

In this embodiment, the nozzle plate has preferably a water repellent layer on the front surface. By providing the water repellent layer, the ink that has spread on the front surface of the nozzle plate once can quickly retreat into the nozzle hole, and the normal meniscus can be quickly formed again.

In this embodiment, the electrodes are preferably arranged to connect the plurality of nozzle holes in series. With this arrangement, when the ink is shot out of the respective nozzle holes, if a conductive state does not occur between the electrodes for any one of the nozzle holes, the fact that the ink does not adhere to the front surface of the nozzle plate after the discharge of the ink droplet can be detected. In other words, it is possible to detect the fact that the ink droplet was not ejected from the nozzle hole.

In this embodiment, in particular, the plurality of nozzle holes are preferably arranged for each color of ink to be discharged. With this arrangement, the fact that the ink droplet was not ejected from the nozzle hole is detected for each color. As described above, there may be various reasons why the ink droplet was not ejected from the nozzle hole, such as clogging of the nozzle with a foreign object and entry of an air bubble. As a measure to solve this, sucking, idle discharge, etc. are performed. In this case, it is not necessary to perform sucking or idle discharge for every color, and the measure may be taken only for the nozzle holes corresponding to the color of the ink droplet that was not ejected, thereby preventing unnecessary ink waste.

In this embodiment, moreover, the electrodes are preferably buried in the nozzle plate in a state being exposed to the inner surface of the nozzle hole, at positions where the electrodes come into contact with only a meniscus formed normally in the nozzle hole. As described above, in order to eject the ink droplet from the nozzle hole, the meniscus must be formed so that it is positioned on the opening edge of the nozzle hole. In short, the normal meniscus must be formed.

In this embodiment, since the electrodes come into contact with only the normally formed meniscus, if the normal meniscus is formed before the ink droplet is ejected from the nozzle hole, a conductive state occurs between the electrodes. In other words, if an abnormal meniscus is formed for some reason, such as the existence of an air bubble, before the ink droplet is ejected from the nozzle hole, an insulated state occurs between the electrodes.

As described above, when the piezoelectric element is deformed, the normal meniscus further retreats deep into the nozzle hole temporarily. Therefore, at this time, the state between the electrodes changes from the conductive state to the insulated state. Moreover, when the deformation of the piezoelectric element recovers, the ink in the nozzle hole is ejected from the nozzle hole as if it is shot. Accordingly, at this time, the state between the electrodes changes from the insulated state to the conductive state again. Further, since the ink returns into the nozzle hole again and forms the normal meniscus after the discharge of the ink droplet, the conductive state is maintained. Since the determining means determines, based on a current flowing between the electrodes, that a conductive state occurs, it is possible to determine that the state between the electrodes momentarily changed from the conductive state to the insulated state and then changed again to the conductive state before and after the discharge of the ink droplet. More specifically, it is possible to detect the fact that the meniscus capable of discharging an ink droplet is formed in the nozzle hole before and after the discharge of the ink droplet. In other words, it is possible to detect the fact that the normal meniscus performs a behavior (normal behavior) capable of discharging an ink droplet in the nozzle hole before and after the discharge of the ink droplet.

In this embodiment, it is preferred that the nozzle plate includes a water repellent layer on the front surface and an insulating layer stacked on the water repellent layer, and the electrodes are sandwiched between the insulating layer and the water repellent layer. In this case, if the normal meniscus is formed, a conductive state certainly occurs between the electrodes. Moreover, a conductive state will never occur between the electrodes by an ink existing in the flow channel on the upstream side of the nozzle hole. It is thus possible to certainly prevent an erroneous operation of the determining means.

In this embodiment, the electrodes are preferably arranged to connect the plurality of nozzle holes in parallel. With this arrangement, when the ink is pushed out of the respective nozzle holes, if an insulated state does not occur between the electrodes for any one of the nozzle holes; it is possible to determine the fact that the normal meniscus does not perform the behavior capable of discharging the ink droplet. In other words, a state in which the ink droplet can not be ejected from the nozzle hole is detected.

In this embodiment, in particular, the plurality of nozzle holes are preferably arranged for each color of ink to be discharged. With this arrangement, the fact that the normal meniscus does not perform the behavior capable of discharging an ink droplet is detected for each color. As described above, there may be various reasons why the normal meniscus is not formed. As a measure to solve this, sucking, idle discharge, etc. are performed. In this case, it is not necessary to perform sucking or idle discharge for every color, and the measure may be taken only for the nozzle holes corresponding to the color of the ink droplet that was not ejected, thereby preventing unnecessary ink waste.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a recording head main body having a nozzle plate in which a plurality of nozzle holes are arranged;

electrodes arranged adjacently with a periphery of an outside edge of the nozzle hole therebetween;

a current detecting section for applying a predetermined voltage between the electrodes and detecting a current flowing between the electrodes; and a controller capable of determining, based on a detection result from said current detecting section, that a conductive state or an insulated state occurs between the electrodes, wherein the detection result is based on a behavior of a meniscus formed in the nozzle hole.

2. The inkjet recording apparatus according to claim 1, wherein said electrodes are buried in the nozzle plate in a state being exposed to an inner surface of the nozzle hole, at positions where said electrodes come into contact with only a meniscus formed normally in the nozzle hole.

3. The inkjet recording apparatus according to claim 2, wherein the nozzle plate has a water repellent layer provided on a front surface and an insulating layer stacked on the water repellent layer, and said electrodes are sandwiched between the insulating layer and the water repellent layer.

4. The inkjet recording apparatus according to claim 2, wherein said electrodes are arranged to connect the plurality of nozzle holes in parallel.

5. The inkjet recording apparatus according to claim 4, wherein the plurality of nozzle holes are arranged for each color of ink to be discharged.

6. An inkjet recording apparatus comprising:

a recording head main body having a nozzle plate in which a plurality of nozzle holes are arranged;

electrodes arranged adjacently with the nozzle hole therebetween;

a current detecting section for applying a predetermined voltage between the electrodes and detecting a current flowing between the electrodes; and a controller capable of determining, based on a detection result from said current detecting section, that a conductive state occurs between the electrodes;

wherein said electrodes are arranged on a front surface of the nozzle plate.

7. The inkjet recording apparatus according to claim 6, wherein said electrodes are separated from an edge of the nozzle hole by approximately 1 μm to 5 μm.

8. The inkjet recording apparatus according to claim 6, wherein the nozzle plate has a water repellent layer on the front surface.

9. The inkjet recording apparatus according to claim 6, wherein said electrodes are arranged to connect the plurality of nozzle holes in series.

10. The inkjet recording apparatus according to claim 9, wherein the plurality of nozzle holes are arranged for each color of ink to be discharged.

11. An inkjet recording apparatus comprising:

a recording head main body having a nozzle plate in which a plurality of nozzle holes are arranged;

electrodes arranged adjacently with a periphery of an outside edge of the nozzle hole therebetween;

current detecting means for applying a predetermined voltage between the electrodes and detecting a current flowing between the electrodes; and determining means for determining, based on a detection result from said current detecting means, that a conductive state or an insulated state occurs between the electrodes; and wherein the detection result is based on a behavior of a meniscus formed in the nozzle hole.

* * * * *